US011577873B2

(12) United States Patent
Stuhlmann et al.

(10) Patent No.: US 11,577,873 B2
(45) Date of Patent: Feb. 14, 2023

(54) DEVICE AND METHOD FOR ATTACHING HANDLES TO PACKAGES OR CONTAINERS, SUCH AS BOTTLES, CANS, BOXES, POUCHES, AND SIMILAR CONTAINERS, OR TO GROUPS OF PACKAGES OR CONTAINERS

(71) Applicant: KHS GMBH, Dortmund (DE)

(72) Inventors: Christopher Stuhlmann, Korbach (DE); Volker Zahn, Volkmarsen (DE); Thomas Nitsch, Kleve (DE); Mathias Fischer, Kevelaer (DE); Michael Wertz, Kleve (DE); Norman Pau, Kleve (DE)

(73) Assignee: KHS GmbH, Dortmund (DE)

( * ) Notice: Subject to any disclaimer, the term of this patent is extended or adjusted under 35 U.S.C. 154(b) by 80 days.

(21) Appl. No.: 17/155,730

(22) Filed: Jan. 22, 2021

(65) Prior Publication Data

US 2021/0139182 A1 May 13, 2021

Related U.S. Application Data

(63) Continuation-in-part of application No. PCT/EP2019/065979, filed on Jun. 18, 2019.

(30) Foreign Application Priority Data

Jul. 25, 2018 (DE) ..... 102018118043.8

(51) Int. Cl.

| | |
|---|---|
| ***B65B 61/14*** | (2006.01) |
| ***B65B 43/52*** | (2006.01) |
| ***B65B 61/06*** | (2006.01) |

(52) U.S. Cl.
CPC ..... *B65B 61/14* (2013.01); *B65B 43/52* (2013.01); *B65B 61/06* (2013.01)

(58) Field of Classification Search
CPC ..... B65B 43/52; B65B 61/06; B65B 61/14
See application file for complete search history.

(56) References Cited

U.S. PATENT DOCUMENTS

| | | | | |
|---|---|---|---|---|
| 3,634,173 | A | 1/1972 | Hoppner | |
| 4,767,390 | A | 8/1988 | Herring | |
| 5,052,165 | A | 10/1991 | Gunther | |
| 5,111,633 | A | 5/1992 | Draghetti | |
| 8,579,779 | B2 | 11/2013 | Totani | |
| 10,654,617 | B2 | 5/2020 | Hoffmann et al. | |
| 2003/0101685 | A1 * | 6/2003 | Jansen | B65B 61/14 53/134.1 |

FOREIGN PATENT DOCUMENTS

| | | |
|---|---|---|
| CN | 101954757 A | 1/2011 |
| CN | 107548372 A | 1/2018 |
| DE | 10056115 | 5/2002 |
| DE | 20207217 | 8/2002 |

(Continued)

*Primary Examiner* — Anna K Kinsaul
*Assistant Examiner* — Himchan Song
(74) *Attorney, Agent, or Firm* — Laurence A. Greenberg; Werner H. Stemer; Ralph E. Locher

(57) ABSTRACT

The application relates to a device and method for attaching handles to packages or containers, such as bottles, cans, boxes, pouches, and similar containers, or to groups of packages or containers.

20 Claims, 9 Drawing Sheets

(56) References Cited

FOREIGN PATENT DOCUMENTS

| | | | | |
|---|---|---|---|---|
| EP | 0560699 | | 9/1993 | |
| EP | 1088761 | | 4/2001 | |
| EP | 1088761 | A1 * | 4/2001 | ..... B65B 61/14 |
| EP | 1464582 | | 10/2004 | |
| EP | 1577219 | | 9/2005 | |
| FR | 2787416 | | 6/2000 | |
| WO | 9412395 | | 6/1994 | |
| WO | WO-9412395 | A1 * | 6/1994 | ..... B65B 61/14 |

* cited by examiner

DEVICE AND METHOD FOR ATTACHING HANDLES TO PACKAGES OR CONTAINERS, SUCH AS BOTTLES, CANS, BOXES, POUCHES, AND SIMILAR CONTAINERS, OR TO GROUPS OF PACKAGES OR CONTAINERS

CROSS-REFERENCE TO RELATED APPLICATIONS

The present application is a Continuation-in-Part of International Patent Application No. PCT/EP2019/065979, filed Jun. 18, 2019, which claims the benefit of Federal Republic of Germany Patent Application No. DE 102018118043, filed Jul. 25, 2018, each of which is incorporated by reference herein in its entirety.

BACKGROUND INFORMATION

1. Technical Field

The application relates to a device and method for attaching handles to packages or containers, such as bottles, cans, boxes, pouches, and similar containers, or to groups of packages or containers. The application also relates to a device for attaching handles to packaging or packaging groups. The application further relates to a method for attaching handles to packaging or packaging groups.

2. Background Art

This section is for informational purposes only and does not necessarily admit that any publications discussed or referred to herein, if any, are prior art. In order to simplify transport, to safeguard the goods themselves against damage or loss, and for improved presentation and therefore to promote sales, goods of all kinds are, as a rule, nowadays packed in packaging or offered in packages.

Likewise, individually packed goods such as, for example, beverages filled into bottles, are assembled to form larger packaging groups or clusters. These are then brought together to form what are referred to as tray packs. In this situation, a number of bottles, such as, for example, four, six, or eight, are combined using a board base and a shrink film to form a mechanically stable sales unit. The principle is also known of bringing together bottles or other containers together to form a packaging unit in such a way that the containers are adhesively bonded to one another using at least one adhesive.

In order to increase customer utilization, many market participants regard it as advantageous if all the packaging groups described heretofore are or can be provided with a carrying handle. Such packaging groups or groups of packages or packaging units are usually of a moderate to a heavy weight for the average worker or consumer to carry by hand, or are of a moderate to a large size, and thus a handle can make it easier for the average worker or consumer to carry such packaging groups by hand.

Hereinafter, all the packaging or packages known in the prior art, such as, for example, bottles, cans, boxes, pouches, bags, clusters, etc., are designated for the sake of simplicity as containers. However, it should be understood that the device and method for attaching handles can be used with most any container or group of containers which are to be carried by hand by a worker or a consumer.

In the majority of cases in which containers are equipped with a handle, the handle takes the form of a carrying strip or band, often made of plastic material, which is configured such as to be self-adhesive on one side. While the beginning and end of this handle strip are pressed by means of suitable devices in each case onto one side of the container, and are therefore adhesively bonded to it, the adhesive side of the middle part of this carrying strip is usually covered by a paper strip in order to avoid the fingers of a customer sticking to the carrying strip, and in order to ensure the configuration of the handle in the form of a handle loop.

For the production of such carrying strips, two methods are commonly used. With the first method, these strips are provided during the actual production process with the paper strips described heretofore, such that these strips need only to be cut to length from an endless strip of carrying strips material and then applied inside the machine which is actually applying the handles. A disadvantage with this method is the fact that any change in the overall format of the handle, be it the total length, the length of the adhesion points, or the locations of the handle loop, incur a change of the plastic carrying strip. In other words, in this method the carrying strips are manufactured as individual strips with the paper cover strip attached, and then this supply of individual strips is provided to the strip-applying arrangement or machine. This method is useful if only one size and configuration of carrying strip is to be applied, but is disadvantageous if carrying strips of varying sizes and configurations are to be applied, as the strip-applying machine would have to be shut down and a supply of carrying strips of one size would have to be switched out for another supply of carrying strips of a different size each time a change in carrying strip was needed.

With another method, a strip form or roll of carrying material is used, which is completely self-adhesive on one side. Inside the machine which applies the handles, the section of the carrying strip which lies between the two intended adhesive points is now provided with a paper strip, wherein the adhesive points required at the beginning and end of the carrying strip remain free. Due to the fact that the length of the carrying strip, the location, and the length of the paper strip can be adjusted in a simple manner to changing requirements, frequent changing of the carrying strip material can be avoided, which in practice represents a major advantage. In other words, in this method the carrying strip can be formed by cutting individual paper cover strips from a supply, usually a roll of material, and then applying the paper cover strips to the self-adhesive plastic material, then cutting the self-adhesive plastic material from a supply, usually a roll, to form carrying strips, immediately or essentially immediately prior to application to containers. The length of the carrying strip can therefore be changed regularly without having to shut down the strip-applying machine or switching out supplies of carrying strips by simply adjusting when the cuts are made in the paper cover material and the self-adhesive plastic supply material.

All the observations made heretofore in connection with the carrying strip material or carrying strip apply by analogy also to the use of carrying strip materials which comprise other materials, such as, for example, paper or metal, or of any desired combinations of these materials.

With regard to the machines or devices which apply the carrying strips, a number of different proposal solutions have been known in the past.

In one carrying strip application device, the handle is applied by means of a comparatively complex arrangement of different levers and pressure rollers. Disadvantageous in this situation is the fact that this device is essentially only suitable for containers in the form of packets, and that an adaptation of the handle to changing container dimensions is only possible to a limited degree.

In another carrying strip application device, the device comprises a rotating plate which can be driven and is arranged centrally and transversely to the conveying direction of the containers. The radial outer ends of the rotating plate are rounded in each case, and provided with two L-shaped levers as retaining means for fixing the endless carrying strip material, provided on one side with an adhesive layer, covered in sections, and with a radially extendible cutting blade as a cutting device for separating the handle from the carrying strip material. At the beginning of the process, the rotating plate stands perpendicular and projects with a first end into the conveying path of the container, wherein, on the side facing towards the containers, a section of the carrying strip material which corresponds to the length of the later handle, with an adhesive layer facing outwards, is held between the two ends of the rotating plate. An incoming container then comes in contact onto the rotating plate with its front side, defined in relation to the conveying direction, as a result of which the beginning of the handle is secured to the container. Next, the rotating plate carries out a rotation through 180 degrees, wherein the containers are at the same time moved onwards by a specific amount, such that the rotational movement then concludes when the second end of the rotating plate comes in contact with the rear side of the container. When this contact takes place, the other end of the handle is applied to the rear side of the container. At the same time, the cutting device arranged in the rotating plate separates the handle from the endless carrying strip material. Disadvantageous with such a device is the fact that the undertaking of the irregular rotational movement of the rotating plate incurs a high degree of technical control effort, wherein, due to the high angular acceleration values incurred, high drive capacities must also be provided. With this device, too, the length of the handle is determined by the overall geometric arrangement of the device, such that an adjustment to changing container dimensions can only be carried out by replacing the rotating plate and extensive adjustment setting work.

In another carrying strip application device, the handle applicator consists essentially of a three-armed rotor, of which the horizontal axis of rotation is arranged transversely to the conveying direction of the containers. Each of these rotor arms is provided with a strip guide for the carrying strip material, a holding and/or pressing device, and a cutting tool. Located between the rotor arms, in proximity to the hub of the rotor, is in each case a vacuum sensor probe, which is intended to monitor the drawing of the carrying strip material without contact, in order for the carrying strip material does not connect the ends of the rotor arms directly in a straight line, but essentially follows the inner contour of the rotor. The actual application of the handle takes place inasmuch as the container runs against a first rotor arm, and thereby takes over the beginning of the handle. Next, the containers move through underneath the rotating rotor and are provided by the following rotor arm in each case with the other end of the handle, wherein the cutting tool located at the end of the respective rotor arm separates the carrier strip material into the appropriate dividing sections. A disadvantage is that, in this situation, by means of the holding and/or pressing device arranged at the rotor arm, it is often the case that, after or during the application and the adhering of carrying strip material to the packaging or the packaging group, a retention force is produced between the holding and/or pressing device and the carrying strip material. With the further rotation of the respective rotor arm, after the pressing and application of the carrying strip material to the packaging or the packaging group, and/or the movement of the packaging or the packaging group away from the rotor arm, this may lead to an undesirable detachment of the carrying strip material from the packaging or the packaging group.

BRIEF SUMMARY

The object of the present application is therefore to provide a device and method for the application of handles to packaging or packing groups which, by use of a holding and/or pressing device, achieves an improved transfer of the carrying strip material onto the packaging or the packaging material group and minimizes and/or avoids the disadvantages of other similar devices described herein above. This object is solved by a device and a method for attaching handles to packaging or packaging groups in accordance with at least one or more of the possible embodiments disclosed herein.

According to a first aspect, the application relates to a device for attaching handles to packaging or packing groups, by means of which the packaging or packaging groups, conveyed on a conveying device in a conveying direction, can each be provided with at least one self-adhesive handle. The device comprises, for this purpose, a motor-driven applicator unit, which is mounted above the conveying device so as to be rotatably drivable about a horizontal axis of rotation lying transverse to the conveying direction. In this situation, the handle applicator unit comprises at least two or at least three applicator arms which are oriented radially to the axis of rotation, and on each of which at least one holding and/or pressing device and a cutting tool are formed. A continuous strip, at least partially provided with an adhesive layer, can be conveyed above each packaging or packaging group, from which continuous strip a handle with an adhesive portion at each free end can be cut off. The handle formed in this manner can be applied to or pressed onto the packaging or the packaging group. Each holding and/or pressing device comprises at least one suction region for at least temporarily holding and/or guiding the endless strip and the handle cut therefrom by the application of an at least temporarily generatable negative pressure. Furthermore, in order to provide the at least temporarily generatable negative pressure, a pressure distribution arrangement is provided, which is designed to at least temporarily supply the respective suction regions of an associated holding and/or pressing device of the corresponding applicator arm with at least a first negative pressure level, depending on the position of rotation. The device and related method permits an exact or complete detachment of the handle from the applicator arms to take place without the handle still continuing to be held at the holding and/or pressing device after the application.

According to at least one possible embodiment, the pressure distribution arrangement is designed to at least temporarily supply the respective suction regions of an associated holding and/or pressing device of the corresponding applicator arm with at least one further level of pressure in addition to the first negative pressure level, depending on the position of rotation of the pressure distribution arrangement.

According to at least one possible embodiment, the at least one further level of pressure lies above the first negative pressure level.

According to at least one possible embodiment, the at least one further level of pressure comprises at least two further levels of pressure comprising at least a first level of pressure and a second level of pressure. The first level of pressure is such that atmospheric pressure or a residual vacuum prevails or occurs at the respective suction region without a direct connection of the suction region to a suction line. The second level of pressure is such that a pressure above atmospheric pressure prevails or occurs at the respective suction region, and a connection pertains between the suction or pressure region and a pressure line.

In other words, the pressure at the suction region, depending on the position of the pressure distribution arrangement, can be a negative pressure below ambient or atmospheric pressure to produce a vacuum effect to hold the carrying strip by suction force against the holding and/or pressing device of the corresponding applicator arm. This negative pressure is generated by a temporary connection to a vacuum source via a connecting hose. The pressure at the suction region can be changed by changing the rotational position of the pressure distribution arrangement. The respective connecting hose can be moved into temporary connection with a pressure source that generates a positive pressure above atmospheric or ambient pressure. The suction region essentially temporarily becomes a blowing region to ensure or promote the disconnection or detachment of the carrying strip from the holding and/or pressing device and attachment to the packaging or packaging group. The pressure at the suction region can be changed again by by changing the rotational position of the pressure distribution arrangement. The respective connecting hose can be moved into temporary disconnection from either the vacuum source or the pressure source, such that the pressure at the suction region could be slightly negative to produce a residual vacuum suction force, or could slightly positive, or could be at atmospheric or ambient pressure. Such a disconnection usually occurs when no carrying strip is in contact with the suction region, or possibly when the carrying strip is initially being drawn from the supply or roll of carrying strip material.

According to one possible embodiment variant, provision is made for the pressure distribution arrangement to be configured in such a way that, depending on the position of rotation of the relative rotation position of the handle applicator, the respective suction region of an associated holding and/or pressing device of the corresponding applicator arm is subjected at least temporarily to at least one first level of negative pressure.

According to a further possible embodiment variant, provision is made for the pressure distribution arrangement to be configured in such a way that the respective suction region of an associated holding and/or pressing device of the corresponding applicator arm is subjected at least during the holding and/or guiding of the endless strip and the handle separated from it, and/or during the pressing of the respective free-end side adhesive sections onto the packaging or packaging group, to at least one first level of negative pressure.

According to a further possible embodiment variant, provision is made for the pressure distribution arrangement to be configured in such a way that, depending on rotational position, the respective suction region of an associated holding and/or pressing device of the corresponding applicator arm is subjected at least temporarily to at least one first level of negative pressure and a second level of negative pressure.

According to a further possible embodiment variant, provision is made for the second level of negative pressure to be configured as a different level of negative pressure from the first level of negative pressure.

According to a further possible embodiment variant, provision is made for the second level of negative pressure to be configured in such a way that, by way of the second level of negative pressure being positive pressure, an air gap can be created in the respective suction region of an associated holding and/or pressing device of the corresponding applicator arm.

According to a further possible embodiment variant, provision is made for the pressure distribution device to be configured in such a way that, at least during and/or after the pressing of the respective free-end side adhesive layers onto the packaging or the packaging group, the respective suction region of an associated holding and/or pressing device of the corresponding applicator arm is subjected to at least one second level of negative pressure.

According to a further possible embodiment variant, provision is made for the applicator arms to be configured as length-adjustable in their respective longitudinal extension along a corresponding longitudinal axis.

According to a further possible embodiment variant, provision is made for the respective holding and/or pressing device of a corresponding applicator arm to comprise in each case two suction regions, wherein, in each case, a first suction region is provided on a corresponding front side, and a second suction region is provided on the corresponding rear side of the holding and/or pressing device formed at an associated applicator arm.

According to a further possible embodiment variant, provision is made for the respective first suction region to be configured as an opening in a plate-shaped format part, which is provided on the corresponding front side in the region of an associated holding and/or pressing device.

According to a further possible embodiment variant, provision is made for the corresponding first format part to be formed from an elastic material or from a foamed material or foam material, and to exhibit a width which is greater than the width of the respective handle.

According to a further possible embodiment variant, provision is made for the first suction region provided in the first format part to be configured as elastically deformable or compressible in the direction of the associated longitudinal axis.

According to a further possible embodiment variant, provision is made for the respective second suction region to be configured as an opening in a plate-shaped format part, which is provided on the corresponding rear side in the region of an associated holding and/or pressing device.

According to a further possible embodiment variant, provision is made for the corresponding second format part to be formed from an elastic material or from a foamed material, and to exhibit a width which is greater than the width of the respective handle.

According to a further possible embodiment variant, provision is made for the second suction region provided in the second format part to be configured as elastically deformable in the direction of the associated longitudinal axis.

According to a further possible embodiment variant, provision is made for the first and/or second suction regions to comprise at least one suction head and a folding bellows element arranged on this, which can be elastically deformed or compressed in the direction of the associated longitudinal axis.

According to a further possible embodiment variant, provision is made that at least one first and/or second format part comprise a concave or substantially concave cambered surface, which is cambered in the direction of the associated longitudinal axis as well as along the longitudinal extension of the associated longitudinal axis.

According to a further possible embodiment variant, provision is made for at least one holding and/or pressing device of a corresponding applicator arm to comprise on its associated rear side at least one spring sheet, which is configured as cambered away from the associated longitudinal axis.

According to a further possible embodiment variant, provision is made that a sensor device is provided in the region of the free end of a corresponding applicator arm, on its corresponding front side, this being configured in each case as a force sensor, which sensor device is configured to produce a sensor signal from which a further rotation of the handle applicator unit can be controlled and/or regulated.

According to a further possible embodiment variant, provision is made for the handle applicator unit to comprise a sensor device, with which the relative rotational position of the individual applicator arms can be detected.

According to another possible embodiment, the application relates to a method for attaching handles to packaging or packaging groups, with which the packaging or packaging groups being conveyed on a conveying device in a conveying direction are provided in each case with at least one self-adhesive handle, wherein an endless strip or supply roll, provided at least in sections with an adhesive layer, is conveyed above each packaging or packaging group, from which a handle with an adhesive portion is separated, and the handle formed in such a way is pressed onto the packaging or packaging group, and wherein the handle is applied to a packaging or packaging group by a label applying or application device according to at least one possible embodiment disclosed herein.

"Packaging" in the meaning of the application also denotes packaging units or containers which are conventionally used in the food sector, such as the beverage sector, wherein "containers" includes all types of containers in the food or beverage sector, such as bottles, cans, and also soft packaging, for example such as are produced from cardboard and/or plastic film and/or metal foil, transport containers, such as bottle, crates, etc. "Packaging groups" in the meaning of the application are packaging elements assembled into groups, such as bundles of such packaging.

The expression "substantially" or "approximately" signifies in the meaning of the application deviations from the exact value in each case by +/−10%, or by +/−5%, and/or deviations in the form of changes which are not of significance for the function.

Further embodiments, advantages, and possible applications are also derived from the following description of exemplary embodiments and from the figures. In this situation, all the features described and/or represented as images are in principle the object of the possible embodiments of the application, individually or in any desired combination, regardless of their arrangement in the claims or reference made to them.

Although some aspects have been described in connection with a device, it is understood that these aspects also represent a description of the corresponding method, such that a block element or a structural element of a device is also to be understood as a corresponding method step or as a feature of a method step. By analogy with this, aspects which have been described in connection with a method step or as a method step also represent a description of a corresponding block or detail or feature of a corresponding device. Some or all of the method steps can be implemented by a hardware apparatus or by making use of a hardware apparatus, such as, for example, a microprocessor, a programmable computer, or an electronic circuit. With some exemplary embodiments, some or several of the most important method steps can be carried out by such an apparatus.

DETAILED DESCRIPTION

In the figures, identical reference numbers are used for elements or components or features that are the same or have the same effect. Moreover, for the sake of easier overview, only those reference numbers are represented in the individual figures which are necessary for the description of the respective figure concerned. In addition, some of the figures show schematic views for the explanation of the operation of at least one possible embodiment. It should be understood that the representations in the figures serve only to explain the underlying principles of at least one possible embodiment. For the sake of easier overview, representation of some constituent parts of the device that are well known in the field of packaging have been omitted.

Figure 1:
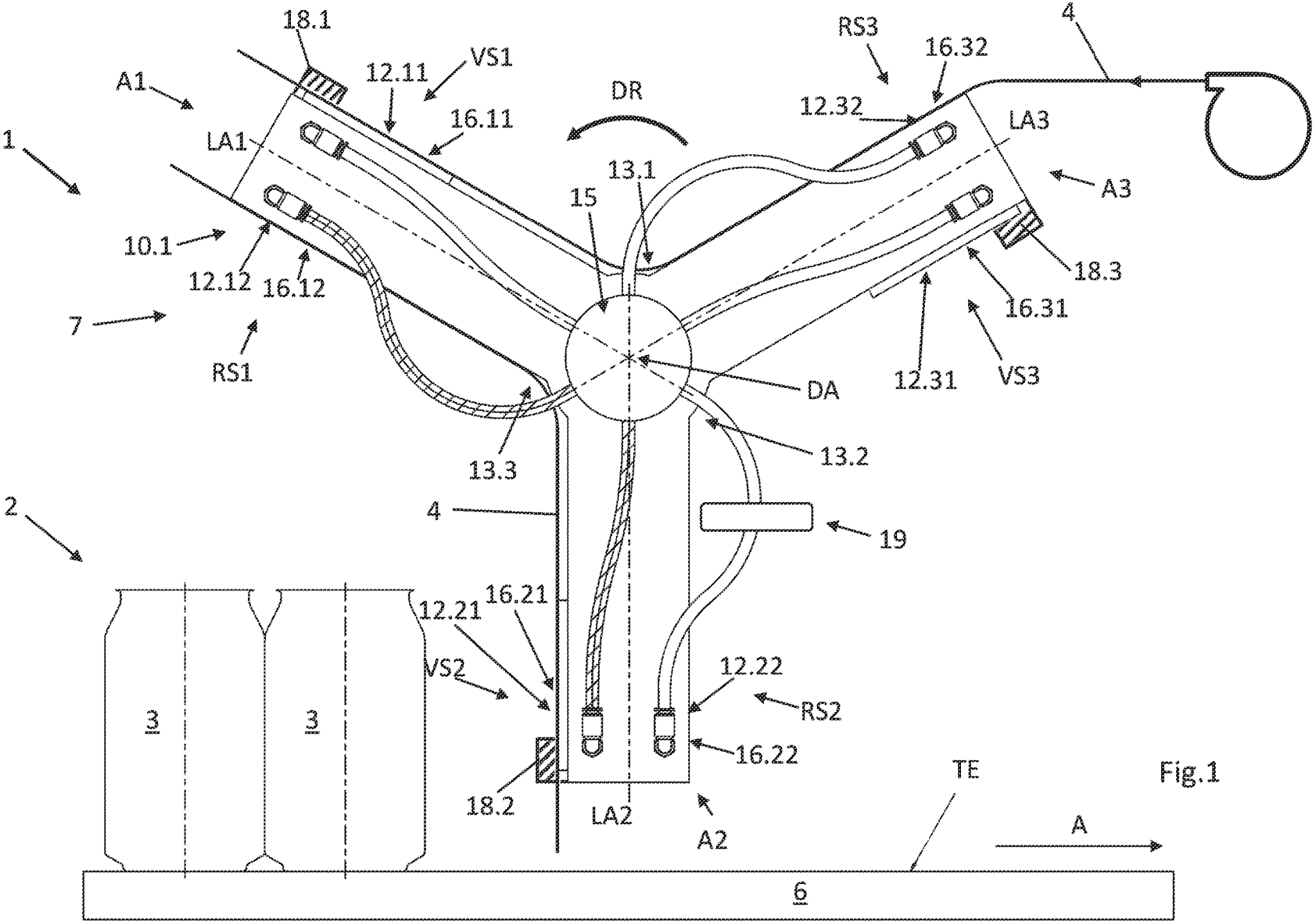
FIG. 1 shows a detailed schematic side view of an exemplary embodiment variant of a device for attaching handles to packaging or packaging groups.

FIG. 1 shows an exemplary embodiment of a handle-attachment device 1 that serves to attach handles 4, also referred to as carrying loops, to the packaging groups 2 or bundles, which in this case include several packaging elements 3 or containers, such as bottles or cans. In FIG. 1, the packaging group comprises a total of four packaging elements 3, which form in the packaging group 2 two rows of two packaging elements 3 each. The packaging elements 3 are connected to one another in a suitable manner to form the packaging group 2, such as, for example, by a surround packing element in the form of a shrink film or shrink wrap, or also by the packaging elements 3 being held to one another in each case by the application of adhesive between contacting surfaces of adjacent containers 3. Each packaging group 2 is provided with a handle 4, which is formed by a carrying strip, this being secured by its ends to the packaging group 2 on opposing sides of the packaging group 2 in an appropriate manner, such as, for example, by adhesive bonding, welding, etc. The carrying strip forming the handle 4 is, for example, made of plastic or other suitable material.

Figure 2:
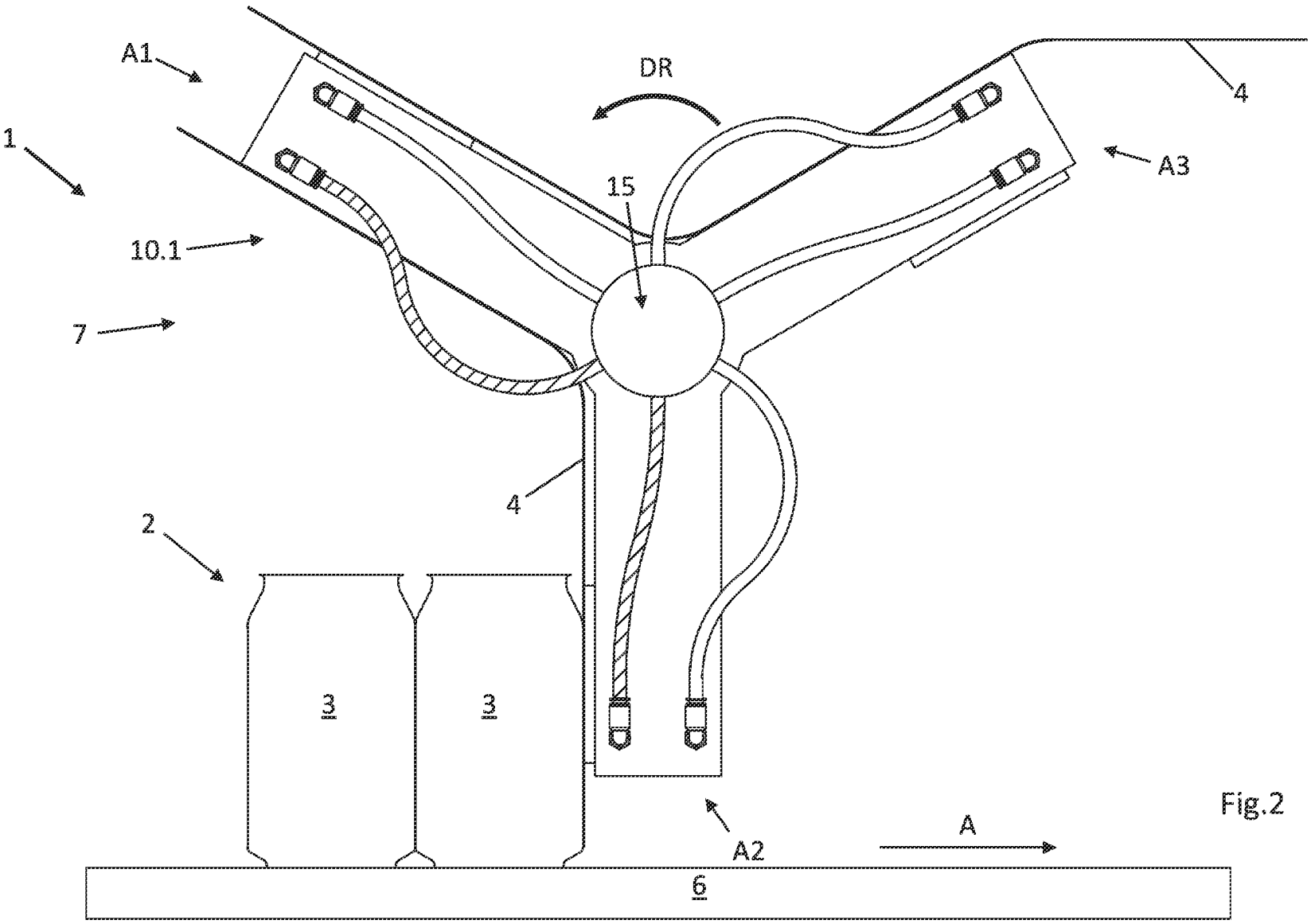
FIG. 2 shows a simplified schematic side view of the handle attachment device in FIG. 1 in a first operational state of attaching a handle.
Figure 3:
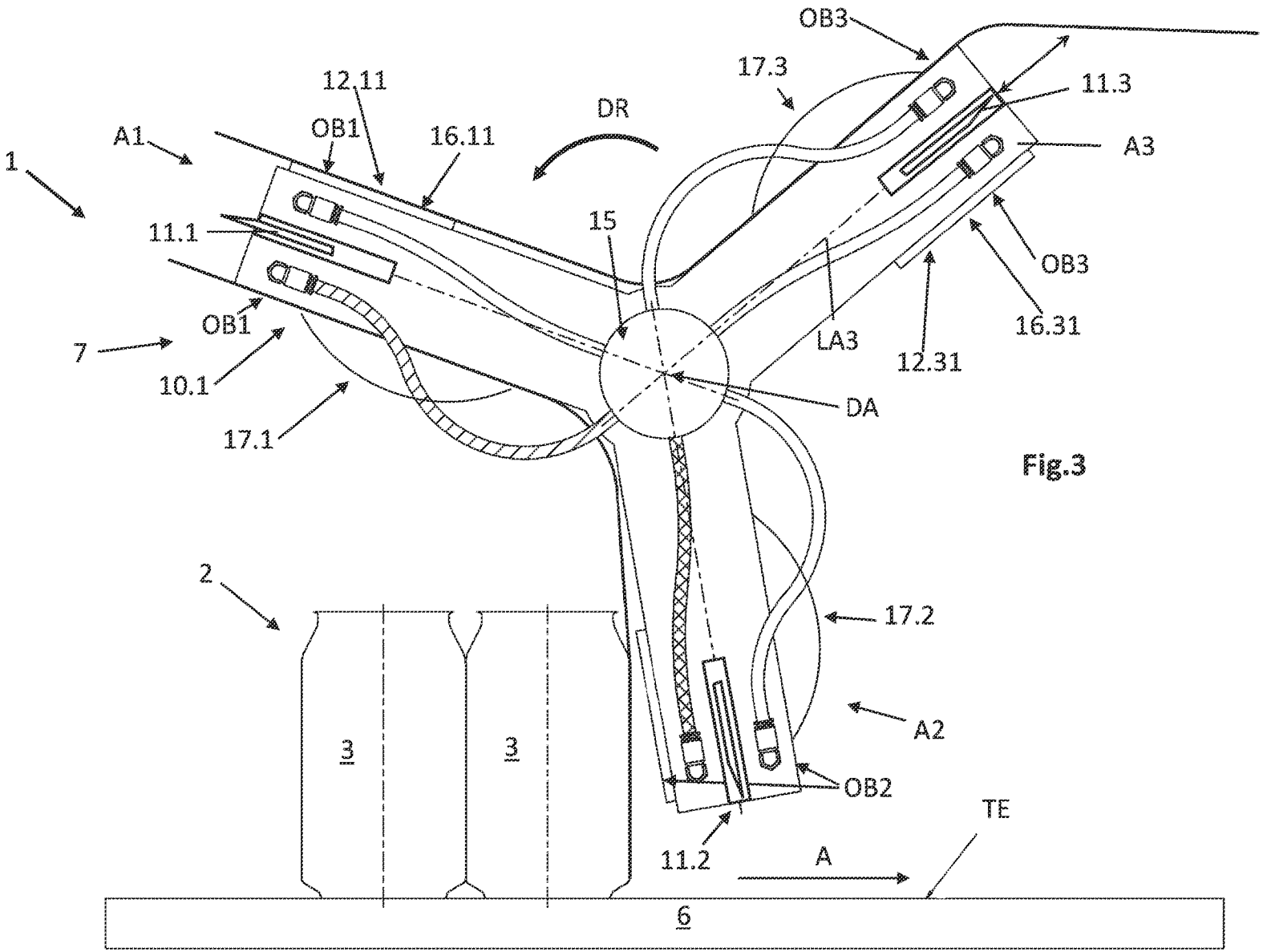
FIG. 3 shows a simplified schematic side view of the handle attachment device in FIG. 1 in a second operational state of attaching a handle.
Figure 4:
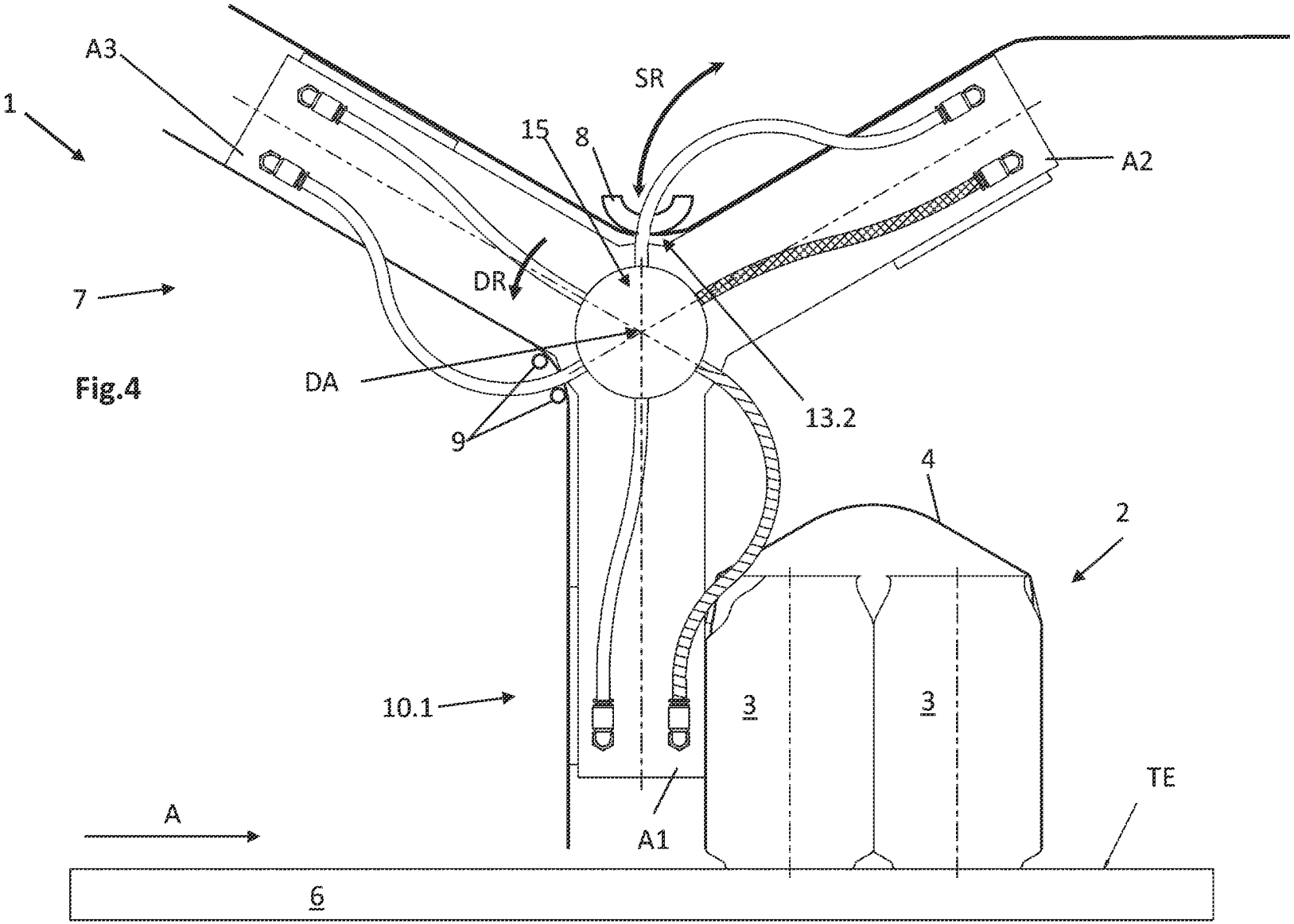
FIG. 4 shows a simplified schematic side view of the handle attachment device in FIG. 1 in a third operational state of attaching a handle.
Figure 5:
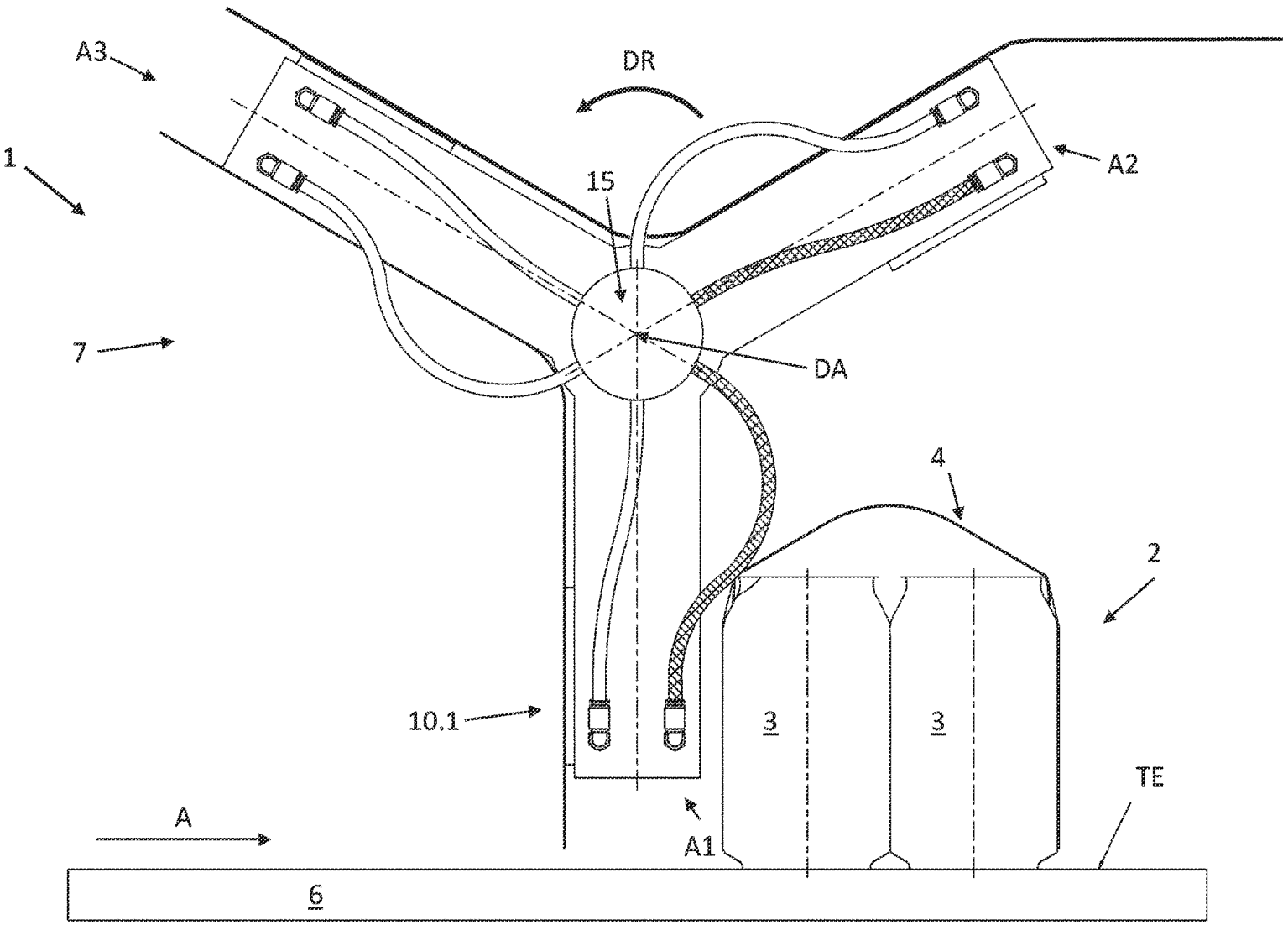
FIG. 5 shows a simplified schematic side view of the handle attachment device in FIG. 1 in a fourth operational state of attaching a handle.

The device 1 is arranged above a conveying device 6, on which the packaging 3 or packaging groups 2 are moved standing upright in a conveying direction A, from left to right as viewed in the figures, on a conveying plane TE. As the packaging group 2 is moved along the conveying plane, it is provided with at least one self-adhesive handle 4, as shown in FIGS. 2-5. FIGS. 2-5 show different operational states of the handle-attachment device 1 of FIG. 1 that represent different steps, in chronological sequence, in the attachment of the handle 4 to the packaging group 2. FIG. 2 shows a first operational state in which one end of the handle 4 is being attached to the packaging group 2 by the device 1, either by attachment to at least one container 3 or by attachment to the packaging material, such as a shrink wrap material, surrounding the containers 3. FIG. 3 shows a second operational state in which the first end of the handle 4 is no longer held by the device 1 and is attached to the packaging group 2. FIG. 4 shows a third operational state in which a second end of the handle 4 is being attached to the packaging group 2 by the device 1. FIG. 5 shows a fourth operational state in which the second end of the handle 4 is no longer held by the device 1 and is attached to the packaging group 2, such that the handle 4 is completely attached to the packaging group 2.

For this purpose the device 1 comprises a handle applicator unit 7, with which the handles 4 are attached to the packaging 3 or packaging groups 2. The handles 4 are formed by drawing off a length of carrying strip material from a store or supply, not represented in any greater detail, of an endless carrier strip material in strip form, such as a roll of carrying strip material. The length of the carrying strip material required for the respective handle is cut off from the strip or roll. The two ends of the carrying strip formed in this way are then connected to the respective packaging group 2 to form the handle 4.

In greater detail, for this purpose the handle applicator unit 7 is driven by a motor and is arranged above the conveying device 6 in such a way that it is mounted so as to be able to rotate about a horizontal axis of rotation DA lying transverse to the conveying direction A. In the embodiment shown, the axis of rotation DA is oriented transversely or at a right angle to the conveying direction A, as well as parallel to the conveying plane TE. The handle applicator unit 7 is driven by a motor in the counter-clockwise direction of rotation DR.

In the exemplary embodiment shown, the handle applicator unit 7 is configured as being adjustable in height or its vertical position by way of an adjustment device, which is not represented in greater detail, relative to the conveying plane TE formed by the conveying device 6. Therefore, the relative distance interval between the axis of rotation DA of the handle applicator unit 7 and the conveying plane TE is arranged so as to be changeable by way of the adjustment device, and therefore a height adjustment of the handle applicator 7 is possible. In other words, the handle applicator unit 7 can be raised and/or lowered with respect to the conveying device 6 to adjust the spacing or distance between the handle applicator unit 7 and the conveying plane TE. This adjustment permits application of handles 4 to packaging units 2 of different dimensions and/or configurations by the device 1. A single device 1 therefore can be used for a variety of packaging units 2 and eliminates the need for separate attachment devices for different packagaing units 2.

The handle applicator unit 7 further comprises three applicator arms A1, A2, A3 oriented radially to the axis of rotation DA, though it should be understood that the handle applicator unit 7 can comprise two, three, or more applicators arms, depending on the specific packaging units to be manufactured. Each of the applicator arms A1, A2, A3 comprises at least one holding and/or pressing device 10.1, 10.2, 10.3, as well as a cutting tool 11.1, 11.2, 11.3, such that an endless strip of the carrying strip material, provided at least in sections with an adhesive layer, can be conveyed in each case above a packaging unit 3 or a packaging group 2, can be cut off, with in each case a free-end side adhesive layer, and the handle 4 formed in such a way can then be applied onto the packaging 3 or the packaging group 2, in particular pressed onto it. In other words, the holding and/or pressing devices 10.1, 10.2, 10.3 draw or pull carrying strip material from the supply of such material, such as a supply roll, and then the cutting tools 11.1, 11.2, 11.3 cut a predetermined or desired length of carrying strip material from the supply roll. The holding and/or pressing devices 10.1, 10.2, 10.3 hold this length of material, i.e., the handle 4, as the handle applicator unit 7 rotates above the conveying device 6 and the packaging unit 2. The holding and/or pressing devices 10.1, 10.2, 10.3 apply or press the handle 4 onto the packaging unit 2, such as is shown in FIGS. 2-5.

In the embodiment represented in the figures, the handle applicator unit 7 comprises three applicator arms A1, A2, A3, namely a first, second, and third applicator arm A1, A2, A3, which in each case are structured as identical to one another, and extend radially away from the axis of rotation DA.

Each of the applicator arms A1, A2, A3 exhibits in this situation a longitudinal axis LA1, LA2, LA3, along which the respective applicator arm A1, A2, A3 extends. Each of the applicator arms A1, A2, A3 is generally configured in its basic form as being rectangular or substantially rectangular. In this situation, the respective longitudinal axes LA1, LA2, LA3 intersect in the axis of rotation DA. In particular, the applicator arms A1, A2, A3 extend at equal or approximately equal angular distances about the axis of rotation DA. For example, as shown in the figures, the applicator arms A1, A2, A3 are positioned such that the corresponding longitudinal axes LA1, LA2, LA3 are at angular distances or intervals or rotational angular distances or intervals of approximately 120 degrees as viewed along the direction of rotation DR.

In addition, each rectangular applicator arm A1, A2, A3 comprises longitudinal side surfaces, which are oriented facing into the drawing plane of the figures, that is, parallel or essentially parallel to the axis of rotation DA. The longitudinal side surfaces comprise front sides VS1, VS2, VS3 as well as rear sides RS1, RS2, RS3. In particular, in this situation the first applicator arm comprises a first front side VS1 and a first rear side RS1, the second applicator arm A2 comprises a second front side VS2 and a second rear side RS2, and the third applicator arm A3 comprises a third front side VS3 and a third rear side RS3.

In this situation, the respective front side VS1, VS2, VS3 of a corresponding applicator arm A1, A2, A3 is connected by a bowed section 13.1, 13.2, 13.3 to a rear side RS1, RS2, RS3 of an adjacent applicator arm A1,A2, A3, provided opposing the direction of rotation DR of the handle applicator unit 7.

In this situation, in order to adjust the format to different handle lengths, the applicator arms A1, A2, A3 are configured as being adjustable in length in their respective longitudinal extensions along the corresponding longitudinal axes LA1, LA2, LA3.

In particular, the applicator arms A1, A2, A3 comprise in each case at least the holding and/or pressing device 10.1, 10.2, 10.3, as well as the cutting tool 11.1, 11.2, 11.3. In greater detail, the first applicator arm A1 comprises at least one first holding and/or pressing device 10.1, as well as a first cutting tool 11.1, the second applicator arm A2 comprises at least one second holding and/or pressing device 10.2 and a second cutting tool 11.2, and the third applicator arm A3 comprises at least one third holding and/or pressing device 10.3 and a third cutting tool 11.3.

The respective cutting tool 11.1, 11.2, 11.3 can in this situation be configured at the corresponding applicator arm A1, A2, A3 as a blade, provided on the free face side or end of the arm and capable of being extended and retracted in a controlled manner, as shown in FIG. 3.

The respective holding and/or pressing device 10.1, 10.2, 10.3 of a corresponding applicator arm A1, A2, A3 further comprises at least one suction region 12.11, 12.12, 12.21, 12.22, 12.31, 12.32 for the at least temporary holding and/or guiding of the endless strip and of the handle 4 cut off the strip by the at least temporarily created negative pressure.

In greater detail, each of the respective holding and/or pressing device 10.1, 10.2, 10.3 of a corresponding applicator arm A1, A2, A3 comprises two suction regions. A first suction region 12.11, 12.21, 12.31 is provided on the corresponding front side VS1, VS2, VS3 of its respective holding and/or pressing device 10.1, 10.2, 10.3. A second suction region 12.12, 12.22, 12.32 is provided on the corresponding rear side RS1, RS2, RS3 of its respective holding and/or pressing device 10.1, 10.2, 10.3.

Figure 7A:
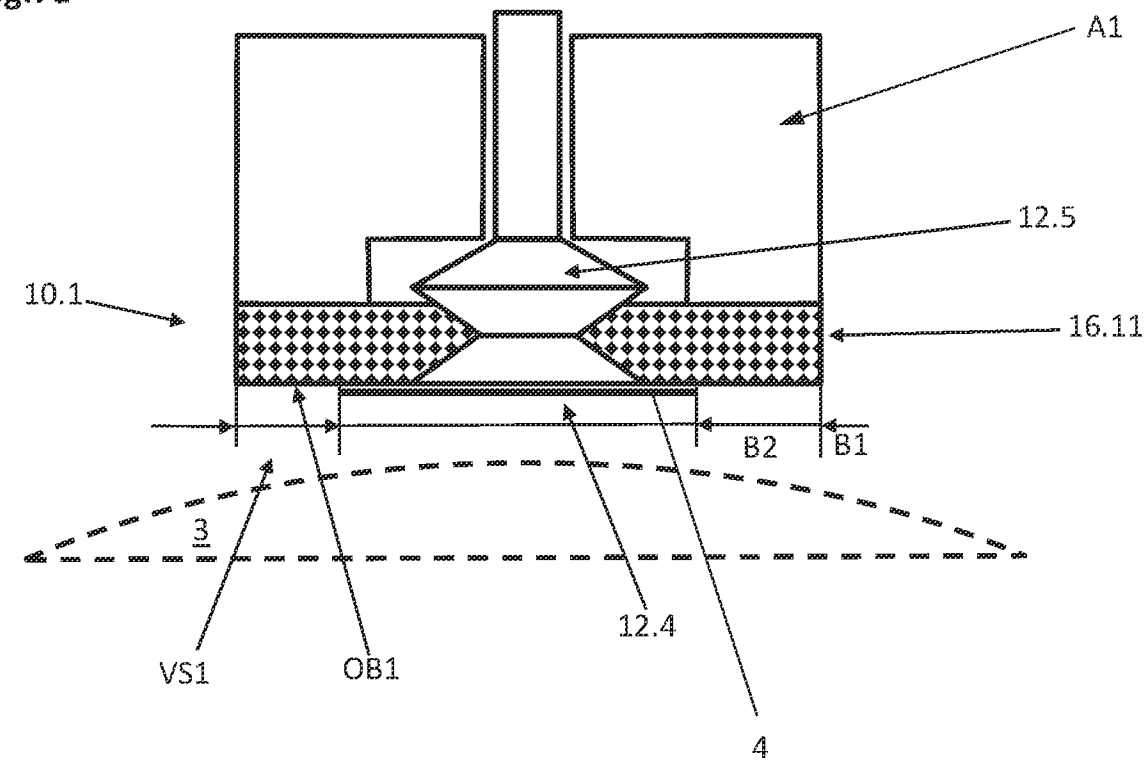
FIG. 7*a* shows a schematic cross-sectional view of a portion of an applicator arm in a first operational state according to an exemplary embodiment variant of a device for attaching handles to packaging or packaging groups.
Figure 7B:
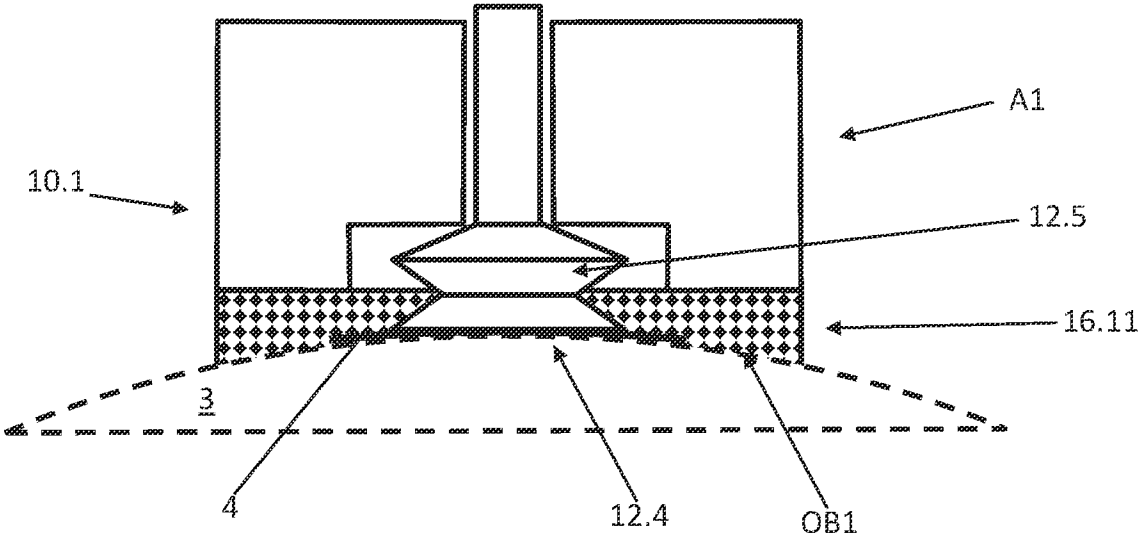
FIG. 7*b* shows a schematic cross-sectional view of the portion of the applicator arm in FIG. 7*a* in a second operational state according to an exemplary embodiment variant of a device for attaching handles to packaging or packaging groups.

Shown by way of example in FIGS. 7*a* and 7*b* is a section of the applicator arm A1, wherein the other applicator arms A2 and A3 are configured as largely identical. The respective first suction region 12.11, 12.21, 12.31 can in this situation be advantageously configured as an opening in a plate-shaped first format part 16.11, 16.21, 16.31, provided and arranged on the corresponding front side VS1, VS2, VS3, in the region of an associated holding and/or pressing device 10.1, 10.2, 10.3. Only a corresponding first format part 16.11 is shown in FIGS. 7*a* and 7*b*, but it should be understood that the description and features relating to first format part 16.11 are applicable to all first format parts 16.11, 16.21, 16.31. The corresponding first format part 16.11 can in this situation be formed from an elastic material or from a foamed material or foam material, and serves both to hold and/or guide the endless strip and the handle 4 cut from the strip, as well as pressing the separated handle 4 onto the packaging 3 and the packaging group 2. The first format part 16.11 is configured so as to be elastically deformable or resiliently deformable or temporarily compressible in the direction of the associated longitudinal axis LA1, LA2, LA3. As shown in FIGS. 7*a* and 7*b*, the first format part 16.11 exhibits a width B1 which is configured as greater than the width B2 of the respective handle 4.

The first suction region 12.11, 12.21, 12.31 provided in the first format part 16.11, 16.21, 16.31 can be configured to be elastically deformable in the direction of the associated longitudinal axis LA1, LA2, LA3. For this purpose, as shown in FIGS. 7*a* and 7*b*, the first suction region 12.11, 12.21, 12.31 can comprise a suction head 12.4 and a folding bellows element 12.5 arranged on the suction head 12.4, which is configured to be elastically deformed or compressed in the direction of the associated longitudinal axis.

The first format part 16.11, 16.21, 16.31 can comprise on its upper side OB1, OB2, OB3, facing away or outwardly from the corresponding longitudinal axis LA1, LA2, LA3, a surface geometry which is matched to the packaging outer side, such that the upper side OB1, OB2, OB3 is in contact entirely or approximately entirely with the packaging outer side. The first format part 16.11, 16.21, 16.31 comprises an upper side OB1, OB2, OB3, cambered or shaped or depressed to be concave or substantially concave inwardly toward the associated longitudinal axis LA1, LA2, LA3, as well as along the longitudinal extension of the associated longitudinal axis LA1, LA2, LA3.

The respective second suction region 12.12, 12.22, 12.32 can in this situation be advantageously configured as an opening in a plate-shaped second format part 16.12, 16.22, 16.32, provided and arranged on the corresponding rear side RS1, RS2, RS3 in the region of an associated holding and/or pressing device 10.1, 10.2, 10.3. The corresponding second format part 16.12, 16.22, 16.32 can in this situation be formed from an elastic material or from a foamed material or foam material, and serves both to hold and/or guide the endless strip and the handle 4 cut from the strip, as well as pressing the separated handle 4 onto the packaging 3 and the packaging group 2. In particular, the second format part 16.12, 16.22, 16.32 is configured so as to be elastically deformable or resiliently deformable or temporarily compressible in the direction of the associated longitudinal axis LA1, LA2, LA3. The second format part 16.12, 16.22, 16.32 exhibits a width B1 which is configured as greater than the width B2 of the respective handle 4.

The second suction region 12.12, 12.22, 12.32 provided in the second format part 16.12, 16.22, 16.32 can be configured to be elastically deformable in the direction of the associated longitudinal axis LA1, LA2, LA3. For this purpose, the second suction region 12.12, 12.22, 12.32 can comprise a suction head 12.4 and a folding bellows element 12.5 arranged on the suction head 12.4, which is configured to be elastically deformed or compressed in the direction of the associated longitudinal axis. Shown in FIGS. 7*a* and 7*b* by way of example is a section of the applicator arm A1, wherein the other applicator arms A2 and A3 are structured as largely identical.

The second format part 16.12, 16.22, 16.32 can comprise, on its upper side OB1, OB2, OB3, facing away or outwardly from the corresponding longitudinal axis LA1, LA2, LA3, a surface geometry which is matched to the packaging outer side, such that the upper side OB1, OB2, OB3 is in contact entirely or approximately entirely with the packaging outer side. The second format part 16.12, 16.22, 16.32 comprises an upper side OB1, OB2, OB3, cambered or shaped or depressed to be concave or substantially concave inwardly toward the associated longitudinal axis LA1, LA2, LA3, as well as along the longitudinal extension of the associated longitudinal axis LA1, LA2, LA3.

Furthermore, the respective holding and/or pressing device 10.1, 10.2, 10.3 of a corresponding applicator arm A1, A2, A3 comprises on its associated rear side RS1, RS2, RS3 at least one spring sheet 17.1, 17.2, 17.3, which is configured as cambered away or convex or projecting outwardly from the associated longitudinal axis LA1, LA2, LA3. As shown in FIG. 3, in one exemplary embodiment there are three spring sheets 17.1, 17.2, 17.3, oriented parallel or substantially parallel to one another in their corresponding longitudinal extension as well as along the longitudinal axis LA1, LA2, LA3, that are arranged on the associated applicator arm A1, A2, A3 in the region of their respective holding and/or pressing device 10.1, 10.2, 10.3. The spring sheets 17.1, 17.2, 17.3 serve to dampen the corresponding applicator arms A1, A2, A3, in the event of impact against the packaging 3 or the packaging group 2, in order to protect them against damage.

Moreover, a sensor device 18.1, 18.2, 18.3 can in each case be provided in the region of the free end of a corresponding applicator arm A1, A2, A3, on its corresponding front side VS1, VS2, VS3, for detecting any mechanical running and/or contact of a corresponding packaging 3 or packaging group 2 against a respective applicator arm A1, A2, A3. In particular, the respective sensor device 18.1, 18.2, 18.3 can be configured as a force sensor or impact sensor configured to generate sensor signals, from or by which sensor signals a further rotation of the handle applicator unit 7 is controlled and/or regulated.

Moreover, the handle applicator unit 7 can comprise a further sensor device 19, with which the relative rotational location or rotational position of the individual applicator arms A1, A2, A3 can be detected. In at least one exemplary embodiment, the sensor device 19 can be provided between the conveying plane TE and the axis of rotation DA. In at least one exemplary embodiment, the sensor device 19 can be configured as a position sensor.

In addition to this, to provide the at least temporarily generated negative pressure at the corresponding suction regions 12.11, 12.12, 12.21, 12.22, 12.31, 12.32, a pressure distribution arrangement 15 is provided, which is configured such as to impose, at least temporarily, at least one first level of negative pressure on the respective suction region 12.11, 12.12, 12.21, 12.22, 12.31, 12.32 of an associated holding and/or pressing device 10.1, 10.2, 10.3 of the corresponding applicator arm A1, A2, A3, depending on the position of rotation. A level of negative pressure is understood in this case to be a pressure which lies below atmospheric pressure and/or below ambient pressure, that is, the ambient or surrounding pressure in the area in which the device 1 is located.

In at least one exemplary embodiment, the pressure distribution arrangement 15 is configured to impose, depending on the rotational position of the relative location and/or the rotational location of the handle applicator unit 7, on the respective suction region 12.11, 12.12, 12.21, 12.22, 12.31, 12.32 of an associated holding and/or pressing device 10.1, 10.2, 10.3 of the corresponding applicator arm A1, A2, A3, at least temporarily, at least one first level of negative pressure.

In at least one exemplary embodiment, the pressure distribution arrangement 15 is configured to impose on the respective suction region 12.11, 12.12, 12.21, 12.22, 12.31, 12.32 of an associated holding and/or pressing device 10.1, 10.2, 10.3 of the corresponding applicator arm A1, A2, A3, at least during the holding and/or guiding of the endless strip and the handle 4 cut from the strip, before and/or during the pressing of the respective free-end side adhesive layers onto the packaging 3 or the packaging group 2, at least one first level of negative pressure to hold the endless strip and the handle 4 cut from the strip.

In greater detail, the pressure distribution arrangement 15 is configured such as to impose on the respective suction region 12.11, 12.12, 12.21, 12.22, 12.31, 12.32 of an associated holding and/or pressing device 10.1, 10.2, 10.3 of the corresponding applicator arm A1, A2, A3, depending on the position of rotation, at least temporarily, at least one first level of negative pressure and a second level of pressure.

The second level of pressure can in this situation be configured as a level of negative pressure which is different from the first level of negative pressure. For example, the second level of pressure can be closer to atmospheric pressure than the first level of negative pressure. In other words, therefore, the first level of negative pressure can be configured as greater than the second level of pressure.

In at least one exemplary embodiment, the second level of pressure can be configured as a positive pressure, which is above atmospheric pressure and/or ambient pressure. Due to the second level of pressure being configured as positive pressure, an air gap is formed in the respective suction region 12.11, 12.12, 12.21, 12.22, 12.31, 12.32 of an associated holding and/or pressing device 10.1, 10.2, 10.3 of the corresponding applicator arm A1, A2, A3.

In at least one exemplary embodiment, the pressure distribution arrangement 15 is configured to impose on the respective suction region 12.11, 12.12, 12.21, 12.22, 12.31, 12.32 of an associated holding and/or pressing device 10.1, 10.2, 10.3 of the corresponding applicator arm A1, A2, A3, at least during and/or after the pressing of the respective free-end side adhesive layers on the packaging 3 or the packaging group 2, at least one second level of pressure.

For this purpose, each suction region 12.11, 12.12, 12.21, 12.22, 12.31, 12.32 of an associated holding and/or pressing device 10.1, 10.2, 10.3 of the corresponding applicator arm A1, A2, A3 is guided by a flexible hose 30 into a rotatably configured cover 15.1 of the pressure distribution arrangement 15. In greater detail, each suction region 12.11, 12.12, 12.21, 12.22, 12.31, 12.32 comprises in the cover 15.1 a connection 15.11, 15.12, 15.21, 15.22, 15.31, 15.32, which can be rotated about the axis of rotation DA conjointly with the handle applicator unit 7, depending on the position of rotation, i.e. synchronously, wherein the connection 15.11 is in fluid operation connection with the suction region 12.11, the connection 15.12 with the suction region 12.12, the connection 15.21 with the suction region 12.21, the connection 15.22 with the suction region 12.22, the connection 15.31 with the suction region 12.31, and, finally, the connection 15.32 with the suction region 12.32, in each case via a corresponding hose 30. Together with the conjointly rotating cover 15.1, the pressure distribution arrangement 15 also comprises a fixed-position housing section 15.2, formed in which are kidney-shaped gas channels GK1, GK2, GK3, GK4.

The gas channels GK1, GK2, GK3, GK4 can then, in their turn, be connected either to a vacuum-generating device, not represented in any greater detail, or to a positive pressure-generating device, likewise not represented in any greater detail, such that the gas channels GK1, GK2, GK3, GK4 can be subjected to negative pressure or positive pressure. The fluid connection of the respective connections 15.11, 15.12, 15.21, 15.22, 15.31, 15.32 to the corresponding gas channel GK1, GK2, GK3, GK4 takes place in this situation dependent on the rotation position, in relation to the respective rotation position of the cover 15.1 of the pressure distribution arrangement 15, which is configured to rotate conjointly and synchronously with the handle applicator unit 7. In this situation, the angle value can be adjusted over the length of the circular sector of the kidney-shaped extension of the respective gas channel GK1, GK2, GK3, GK4, while the respective connection 15.11, 15.12, 15.21, 15.22, 15.31, 15.32 can be fluid-connected, depending on the rotation position, to the associated gas channel GK1, GK2, GK3, GK4, i.e. can be subjected to negative or positive pressure.

In at least one exemplary embodiment, the pressure distribution arrangement 15 comprises four gas channels GK1, GK2, GK3, GK4, namely a first gas channel GK1, a second gas channel GK2, a third gas channel GK3, and a fourth gas channel GK4, wherein the first and second gas channels GK1, GK2 are configured as negative pressure channels, which can be subjected to at least one level of negative pressure, and the third and fourth gas channels GK3, GK4, are configured as positive pressure channels, which can be subjected to a level of positive pressure.

Moreover, the first and third gas channels GK1, GK3 extend about a common radius and in this situation can be connected with the respective suction regions 12.11, 12.21, 12.31, while the second and fourth gas channels GK2, GK4 are provided about a common radius which is comparatively smaller than that of the first and third gas channels GK1, GK3, and in this situation can be connected to the respective second suction regions 12.12, 12.2, 12.32, provided on the rear side RS of the respective applicator arms A1, A2, A3.

In at least one exemplary embodiment, the individual suction regions 12.11, 12.12, 12.21, 12.22, 12.31, 12.32 of an associated holding and/or pressing device 10.1, 10.2, 10.3 of the corresponding applicator arm A1, A2, A3, depending on the rotation position, can be subjected at least temporarily to at least one first level of negative pressure and to a second level of pressure.

According to one exemplary embodiment variant, not represented, provision can also be made for the respective suction regions 12.11, 12.12, 12.21, 12.22, 12.31, 12.32 to be connected in each case by a controllable valve device to the pressure distribution arrangement 15, which vents the corresponding suction regions 12.11, 12.12, 12.21, 12.22, 12.31, 12.32 in relation to atmospheric pressure, i.e. connects them to the atmosphere.

For example, the device 1 according to at least one possible embodiment runs through the working cycle described in greater detail hereinafter, for attaching handles 4 to packaging 3 or packaging groups 2.

In the illustration represented in FIG. 1, it is intended that the packaging group 2, being conveyed on the conveying device 6 in the conveying direction A, is to be provided with a handle 4. For this purpose, the second applicator arm A2 of the handle applicator unit 7 is located in a vertical position, in which its longitudinal axis LA2 preferably points perpendicularly onto the conveying plane TE.

Held on the vertically oriented second applicator arm A2 is a handle 4, which has already been separated from an endless strip by means of the first cutting tool 11.1. This handle is held at the first and second applicator arms A1 and A2 by their respective holding and/or pressing devices 10.1, 10.2, specifically by the second suction region 12.21 of the second front side VS2 of the second applicator arm A2 and by the first suction region 12.12 of the first rear side RS1 of the first applicator arm A1, by a suction force generated by a first level of negative pressure. In order to obtain a defined or predetermined or desired length of the handle 4, the strip of material is also held in the bowed section 13.3 by a mechanical holding structure, such as a pivoting finger, or by a negative pressure. In this situation, the adhesive layers at the free-end side of what will later be the handle 4 project as loose ends out over the first and second applicator arms A1, A2.

The self-adhesive side of what will later be the handle 4 face toward or point in the direction of the packaging group 2 which is being conveyed. The packaging group 2 is being conveyed by the conveying device 6 in the conveying direction A, and comes in contact against the vertical second applicator arm A2, and therefore against the free end, configured as self-adhesive, of the handle 4, held at the first and second applicator arms A1, A2. As a result, the free-end side adhesive portion is fixed on one side to the packaging group 3, as shown in FIG. 2.

In at least one exemplary embodiment, in this situation the second suction region 12.21 of the associated second holding and/or pressing device 10.2 of the second applicator arm A2, at least during and/or after the pressing of the respective free-end side adhesive portions onto the packaging 3 or the packaging group 2, is imposed on by at least one second level of pressure, such as a level of positive pressure. As a result of this, a specifically defined detachment takes place of the handle 4 from the second holding and/or pressing device 10.2.

At the same time, the contacting of the packaging group 2 with the second applicator arm A2 generates a sensor signal in the sensor device 18.2, and causes a further rotation of the handle applicator unit 7 in the counter-clockwise direction of rotation DR, as shown in FIG. 3. Also represented in FIG. 3, for the applicator arm 3 as an example for all the applicator arms, and also for the other FIGS. 1 to 6, is the cutting tool 11.3, which can be moved linearly in the axis direction LA3 and serves to cut off the endlessly incoming handles 4, when these lie tensioned over the end surfaces of the respective application arm. In other words, FIG. 3 shows the cutting tools 11.1, 11.2, 11.3 for the applicator arms A1, A2, A3. The cutting tools 11.1, 11.2, 11.3 are only shown in FIG. 3 for simplicity, but it should be understood that they can be used in any embodiment of the device 1 disclosed in the application or shown in the figures. The cutting tools 11.1, 11.2, and 11.3 can be extended to cut off a strip of carrying material and can be retracted when not in use for cutting.

The speed of rotation of the handle applicator unit 7 is in this situation is matched or essentially matched to the conveying speed of the packaging group 2 being conveyed on the conveying device 6 in the conveying direction A, in such a way that the first applicator arm A1, on reaching approximately its orientation in which the first applicator arm A1 and the longitudinal axis LA1 thereof is pointing or oriented perpendicular in the direction of the conveying plane TE, runs to the upstream-side rear face side of the packaging group 2, and the handle 4 is pressed with its free-end side adhesive portion onto the packaging group 3, as shown in FIG. 4. In FIG. 4, again by way of an example of an embodiment of the device 1, a contact body 8 is represented, which can be pivoted in the direction of the double arrow RS, which guides the handle 4, which is newly introduced and horizontally tensioned initially over the ends of the two upright applicator arms A2 and A3, into the desired low position in the bowed section 13.2, such that it is can be secured and held in the suction region 12.11, 12.12, 12.21, 12.22, 12.31, 12.32 by the respective suction head 12.4. There, the handle 4 is then held in this low position or holding position by fixing and guide fingers 9, which circulate with the applicator arms. For this purpose, these fixing and guide fingers 9 can be pivoted from a position of rest, which is not shown, into the holding position shown in FIG. 4. In the opened position of rest, a handle 4 can be laid in the bowed section or released again. At each bowed section 13.1, 13.2, 13.3, at least one guide finger 9 is provided, while only one contact body 8 is provided, and of which the pivot drive is arranged secured to the device 1 and interacts with the handle applicator unit 7. To further explain, in the embodiment example in FIG. 4, there is one contact body 8 at the top of the device that is pivotable between an engaged position in contact with a handle strip 4, as shown in FIG. 4, and a disengaged position not in contact with the handle strip 4. There are three pairs of guide fingers 9, one pair at each bowed section 13.1, 13.2, 13.3, though only one is shown for sake of simplicity. The pairs of guide fingers 9 are pivotable between an engaged position in contact with a handle strip 4, as shown in FIG. 4, and a disengaged position not in contact with the handle strip 4. The guide fingers 9 move with the rotation of the applicator arms A1, A2, A3, whereas the contact body 8 does not move with the rotation of the applicator arms A1, A2, A3.

In at least one exemplary embodiment, in this situation the first suction region 12.12 of the associated first holding and/or pressing device 10.1 of the first applicator arm A1, at least during and/or after the pressing of the respective free-end side adhesive portions, is imposed on the packaging 3 or the packaging group 2, by means of at least one second level of pressure, preferably a level of positive pressure. As a result of this a specifically defined release takes place of the handle 4 from the first holding and/or pressing device 10.1.

Next, a packaging group 3, provided with a handle 4 in such a manner as described, can be conveyed onwards in the conveying direction A by means of the conveying device 6.

Figure 6:
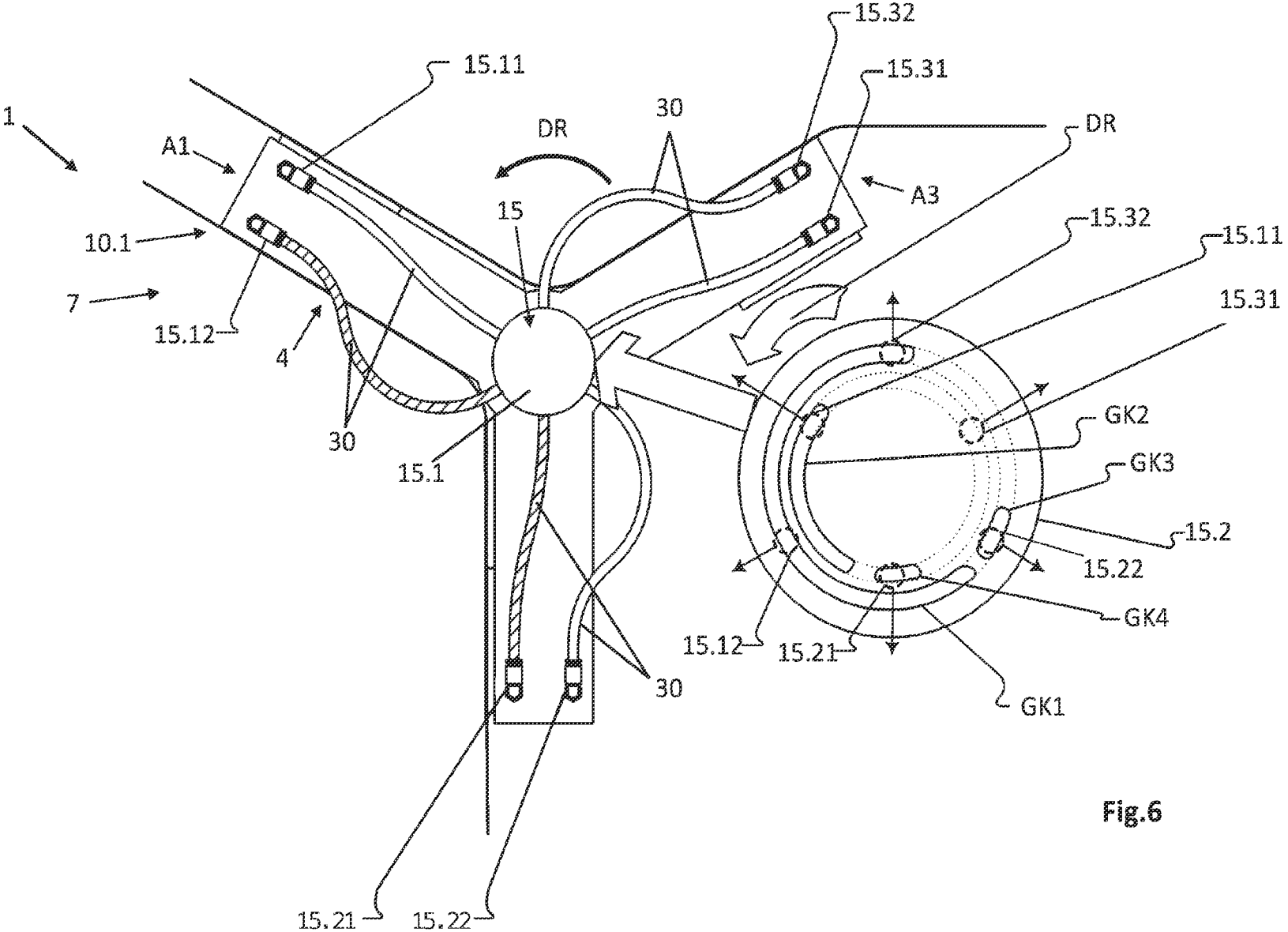
FIG. 6 shows a detailed schematic side view of an exemplary embodiment variant of a device for attaching handles to packaging or packaging groups, including an expanded view of a pressure distribution arrangement.

To further explain, in order to hold the carrying strip material with the applicator arms A1, A2, A3, either when the carrying strip material is still attached to the supply roll or after it is separated from the supply roll to form a handle 4, a negative pressure is generated at the corresponding suction regions 12.11, 12.12, 12.21, 12.22, 12.31, 12.32, though not all of the suction regions at the same time. For example, in the exemplary embodiment shown in FIG. 6, three of the hoses 30 are connecting three suction regions 12.11, 12.12, and 12.32 to the vacuum source. It should be noted that, in FIG. 6, the packaging elements 3 and conveyor 6 have been omitted for simplicity. Specifically, suction regions 12.12 and 12.32 are temporarily operatively connected via the first gas channel GK1 to the vacuum source that generates a negative pressure at the suction regions 12.12 and 12.32. Suction region 12.11 is temporarily operatively connected via the second gas channel GK2 to the vacuum source that generates a negative pressure at the suction region 12.11. During rotation of the handle applicator unit 7, the negative pressure holds in place any carrying strip material at these three suction regions 12.11, 12.12, and 12.32. In accordance with at least one possible embodiment, different levels of negative pressure can be provided to generate differing suction forces that can be higher or lower than one another to hold the carrying strip material more or less securely. At the same time, suction region 12.21 is temporarily operatively connected via the fourth gas channel GK4 to a positive pressure source that generates a positive pressure at the suction region 12.21, and suction region 12.22 is temporarily operatively connected by the third gas channel GK3 to the positive pressure source that generates a positive pressure at the suction region 12.22. It should be noted that while the regions 12.11, 12.12, 12.21, 12.22, 12.31, 12.32 are referred to as "suction" regions, they essentially function as blowing regions when they are connected to the positive pressure source. Therefore, as shown in FIG. 6, "suction" regions 12.21 and 21.22 are functioning as blowing regions. The purpose of temporarily utilizing positive pressure when an applicator arm is in the position that applicator arm A2 is in FIG. 6 is to promote separation of the carrying strip material from the applicator arm A2, and to promote pressing and transfer of the handle 4 onto the packages 3 or packaging unit 2. In at least one possible embodiment, even a lesser negative pressure or atmospheric pressure or ambient pressure could possibly facilitate separation and transfer of the carrying strip material from the applicator arm A1, A2, A3. Finally, suction region 12.31 is not connected to any of the gas channels GK1, GK2, GK3, GK4, and thus ambient or atmospheric pressure, or possibly a residual or low positive or negative pressure, occurs at the suction region 12.31. It is not necessary for suction region 12.31 to be connected to the vacuum source or the positive pressure source because no carrying strip material is being held by the suction region 12.31 in that position shown in FIG. 6. The handle 4 at that point has already been released by the suction region 12.31, so there is no need for a positive or negative pressure force.

Because of the rotary design of the pressure distribution arrangement 15, each of the suction regions 12.11, 12.12, 12.21, 12.22, 12.31, 12.32 will cycle through positive, negative, and ambient or atmospheric pressures, depending on the rotary position of the handle applicator unit 7 and the specific function to be performed, whether it be holding or releasing carrying strip material to or from the applicator arms A1, A2, A3. These pressures can be varied and controlled so that the carrying strip material can be held securely when necessary, and can be released completely when necessary.

Figure 8:
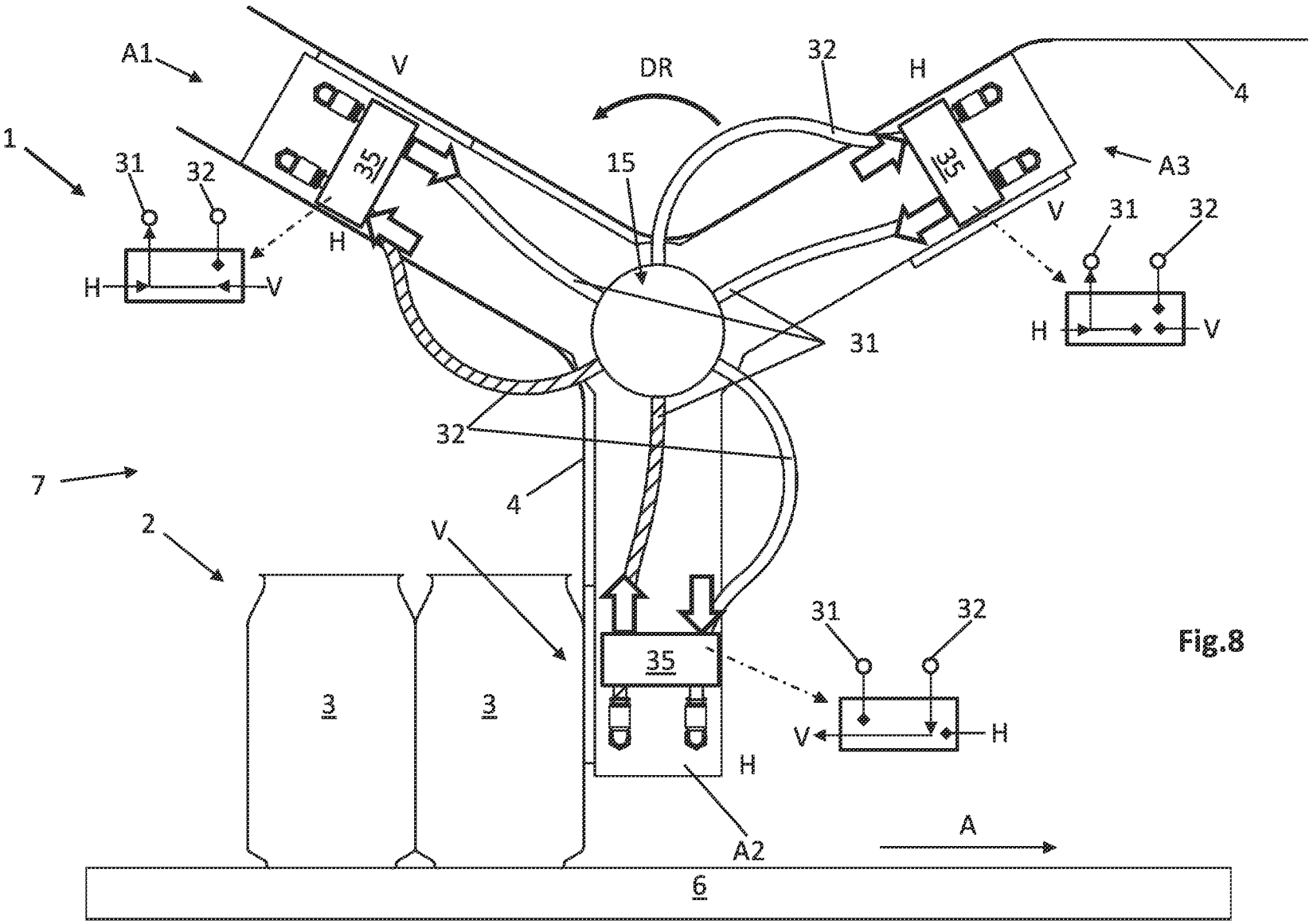
FIG. 8 shows a schematic view of a valve arrangement of the applicator arms of an exemplary embodiment variant of a device for attaching handles to packaging or packaging groups.

Shown in FIG. 8 is an alternative embodiment, with which an electrically controlled valve group or multi-way valve is provided at each applicator arm A1, A2, A3. Each of these valve groups or these multi-way valves 35 is permanently connected to a corresponding source by means of a suction line 31 and a high-pressure line 32. By means of an appropriate sensor signal or control signal, the valve group or the multi-way valve 35 is switched accordingly, in a manner analogous to the exemplary embodiments described heretofore, so as to hold the handle 4 securely by a vacuum force or, by a pressure pulse, to release it. These switching positions are shown in schematic form adjacent to the respective applicator arm, in the respective rotation position shown. The intermediate or transitional switching positions are derived in an analogous manner. For simplicity, the suction regions 12.11, 12.12, 12.21, 12.22, 12.31, 12.32 and generally referred to as either a first side or surface H or a second side or surface V of each of the applicator arms A1, A2, A3.

The present application describes exemplary embodiments, none of which should be understood as limiting another possible embodiment or the claims. It is understood that a large number of modifications or derivations are possible without thereby departing from the scope of protection of the application defined by the claims.

The invention relates to a device for attaching handles to packaging or packaging groups. According to a first aspect, the invention relates to a device for attaching handles to packaging or packaging groups by means of which the packaging or packaging groups conveyed on a conveying device in a conveying direction can each be provided with at least one self-adhesive handle. The device comprises, for this purpose, a motor driven handle applicator unit which is mounted above the conveying device so as to be rotatably drivable about a horizontal axis of rotation perpendicular to the conveying direction. The handle applicator unit has at least two applicator arms which are oriented radially relative to the axis of rotation and on each of which at least one holding and/or pressing device and a cutting tool are formed so that a continuous strip at least partially provided with an adhesive layer can be conveyed above each packaging or packaging group, a handle with an adhesive portion at each free end can be cut from the continuous strip and the handle formed in this manner can be applied to, in particular pressed onto, the packaging or the packaging group. According to the invention, each holding and/or pressing device has at least one suction region for at least temporarily holding and/or guiding the continuous strip and the handle cut therefrom by means of an at least temporarily generatable negative pressure. Furthermore, in order to provide the at least temporarily generatable negative pressure, a pressure distribution arrangement is provided which is designed to at least temporarily supply the respective suction regions of an associated holding and/or pressing device of the corresponding applicator arm with at least a first negative pressure level depending on the position of rotation.

At least partial list of reference numerals, with reference numeral listed first: 1 device; 2 packaging group; 3 packaging; 4 handle; 6 conveying device; 7 handle applicator unit; 8 contact body; 9 fixing and guide finger; 10.1 . . . 10.3 holding and/or pressing device; 11.1 . . . 11.3 cutting tool; 12.11 . . . 12.32 suction region; 12.4 suction head; 12.5 folding bellows; 13.1 . . . 13.3 bowed section; 15 pressure distribution arrangement; 15.1 cover; 15.2 housing section; 15.11 . . . 15.32 connection; 16.11 . . . 16.32 format part; 17.1 . . . 17.3 spring sheet; 18.1 . . . 18.3 sensor device; 19 sensor device; 30 hose; A conveying direction; A1 . . . A3 applicator arm; B1 width; B2 width; DA axis of rotation; DR direction of rotation; GK1 . . . GK4 gas channel; TE conveying plane; LA1 . . . LA3 longitudinal axis; VS1 . . . VS3 front side; SR pivot direction; RS1 . . . RS3 rear side; and OB1 . . . OB3 upper side.

At least one possible embodiment of the present application relates to a device for attaching handles 4 to packaging 3 or packaging groups 2, by which device the packaging 3 or packaging groups 2 being conveyed on a conveying device 6 in a conveying direction A can in each case be provided with at least one handle 4 or at least one self-adhesive handle 4, wherein the device 1 comprises a motor-driven handle applicator unit 7, which can be driven above the conveying device 6 mounted such as to rotate about a horizontal axis of rotation DA lying transverse to the conveying direction A, wherein the handle applicator unit 7 comprises at least two applicator arms A1, A2, A3 oriented radially to the axis of rotation DA, formed at which in each case is at least one holding and/or pressing device 10.1, 10.2, 10.3 and a cutting tool 11.1, 11.2, 11.3, such that an endless strip, provided at least in sections with an adhesive layer, can be conveyed in each case over a packaging 3 or a packaging group 2, from which a handle 4, with in each case a free-end side adhesive portion, can be cut off, and a handle 4 formed in this way can be applied or pressed onto the packaging 3 or the packaging group 2, wherein the respective holding and/or pressing device 10.1, 10.2, 10.3 comprises at least one suction region 12.11, 12.12, 12.21, 12.22, 12.31, 12.32 for holding and/or guiding the endless strip, as well as the handle 4 cut from the strip, with a generated negative pressure, wherein a pressure distribution arrangement 15 is provided, with which the negative pressure can be controlled in respect of its duration and/or intensity, wherein, in order to provide the at least temporarily generated negative pressure, the pressure distribution arrangement 15, is configured such as to subject the respective suction region 12.11, 12.12, 12.21, 12.22, 12.31, 12.32 of a related holding and pressing device 10.1, 10.2, 10.3 of the corresponding applicator arm A1, A2, A3, depending on its position or its position of rotation, at least temporarily, to a first level of negative pressure, and at specific times to at least one further level of pressure.

At least one possible embodiment of the present application relates to the device for attaching handles 4 to packaging 3 or packaging groups 2, wherein the at least one further level of pressure lies above the first negative pressure level.

At least one possible embodiment of the present application relates to the device for attaching handles 4 to packaging 3 or packaging groups 2, wherein the at least one further level of pressure comprises two levels of pressure, wherein at one level of pressure, atmospheric pressure or a residual vacuum prevails, without a direct connection of the suction region 12.11, 12.12, 12.21, 12.22, 12.31, 12.32 to a suction line, and at a further temporary level of pressure, a pressure above atmospheric pressure prevails, and a connection pertains between the pressure region 12.11, 12.12, 12.21, 12.22, 12.31, 12.32 and a pressure line.

At least one possible embodiment of the present application relates to the device for attaching handles 4 to packaging 3 or packaging groups 2, wherein the pressure distribution arrangement 15 is configured such as to subject the respective suction region 12.11, 12.12, 12.21, 12.22, 12.31, 12.32 of an associated holding and/or pressing device 10.1, 10.2, 10.3 of the corresponding applicator arm A1, A2, A3, dependent on the position and the relative rotational location of the handle applicator unit 7, at least temporarily to at least one first level of negative pressure.

At least one possible embodiment of the present application relates to the device for attaching handles 4 to packaging 3 or packaging groups 2, wherein the pressure distribution arrangement 15 is configured such as to impose the respective suction region 12.11, 12.12, 12.21, 12.22, 12.31, 12.32 of an associated holding and/or pressing device 10.1, 10.2, 10.3 of the corresponding applicator arm A1, A2, A3 at least during the holding and/or guiding of the endless strip and the handle 4 cut from the strip, before and/or during the pressing of the respective free-end side adhesive portions onto the packaging 3 or the packaging group 2 by generation of at least one first level of negative pressure.

At least one possible embodiment of the present application relates to the device for attaching handles 4 to packaging 3 or packaging groups 2, wherein the pressure distribution arrangement 15 is configured such as to subject the respective suction region 12.11, 12.12, 12.21, 12.22, 12.31, 12.32 of an associated holding and/or pressing device 10.1, 10.2, 10.3 of the corresponding applicator arm A1, A2, A3, dependent on its position, at least temporarily to at least one first level of negative pressure and to a second level of pressure.

At least one possible embodiment of the present application relates to the device for attaching handles 4 to packaging 3 or packaging groups 2, wherein the second level of pressure is configured as a level of negative pressure which is different from the first level of negative pressure.

At least one possible embodiment of the present application relates to the device for attaching handles 4 to packaging 3 or packaging groups 2, wherein the second level of pressure is configured as a level of positive pressure, such that, due to the second level of pressure being configured as a positive pressure, an air gap can be created in the respective suction region 12.11, 12.12, 12.21, 12.22, 12.31, 12.32 of an associated holding and/or pressing device 10.1, 10.2, 10.3 of the corresponding applicator arm A1, A2, A3.

At least one possible embodiment of the present application relates to the device for attaching handles 4 to packaging 3 or packaging groups 2, wherein the pressure distribution arrangement 15 is configured such as to impose the respective suction region 12.11, 12.12, 12.21, 12.22, 12.31, 12.32 of an associated holding and/or pressing device 10.1, 10.2, 10.3 of the corresponding applicator arm A1, A2, A3, at least during and/or after the pressing of the respective free-end side adhesive portions, on the packaging 3 or the packaging group 2 by application of at least one second level of pressure.

At least one possible embodiment of the present application relates to the device for attaching handles 4 to packaging 3 or packaging groups 2, wherein the applicator arms A1, A2, A3 are configured such as to be length adjustable in their respective longitudinal extension along a corresponding longitudinal axis LA1, LA2, LA3.

At least one possible embodiment of the present application relates to the device for attaching handles 4 to packaging 3 or packaging groups 2, wherein the respective holding and/or pressing device 10.1, 10.2, 10.3 of a corresponding applicator arm A1, A2, A3 comprises in each case two suctions regions 12.11, 12.12, 12.21, 12.22, 12.31, 12.32, wherein in each case a first suction region 12.11, 12.21,12.31 is provided on a corresponding front side VS1, VS2, VS3 and in each case a second suction region 12.12, 12.22, 12.32 on the corresponding rear side RS1, RS2, RS3 of the holding and/or pressing device 10.1, 10.2, 10.3 formed on an associated applicator arm A1, A2, A3.

At least one possible embodiment of the present application relates to the device for attaching handles 4 to packaging 3 or packaging groups 2, wherein the respective first suction region 12.11, 12.21, 12.31 is configured as an opening in a plate-shaped format part 16.11, 16.21, 16.31, which is provided on a corresponding front side VS1, VS2, VS3 in the region of an associated holding and/or pressing device 10.1, 10.2, 10.3.

At least one possible embodiment of the present application relates to the device for attaching handles 4 to packaging 3 or packaging groups 2, wherein the corresponding first format part 16.11, 16.21, 16.31 is formed from an elastic material or from a foamed material, and exhibits a width B1 which is configured as greater than the width B2 of the respective handle 4.

At least one possible embodiment of the present application relates to the device for attaching handles 4 to packaging 3 or packaging groups 2, wherein the first suction region 12.11, 12.21, 12.31 provided in the first format part 16.11, 16.21, 16.31 is configured as elastically deformable in direction of the associated longitudinal axis LA1, LA2, LA3.

At least one possible embodiment of the present application relates to the device for attaching handles 4 to packaging 3 or packaging groups 2, wherein the respective second suction region 12.12, 12.22, 12.32 is configured as an opening in a plate-shaped format part 16.12, 16.22, 16.32 provided on the corresponding rear side RS1, RS2, RS3 in the region of an associated holding and/or pressing device 10.1, 10.2, 10.3.

At least one possible embodiment of the present application relates to the device for attaching handles 4 to packaging 3 or packaging groups 2, wherein the second format part 16.12, 16.22, 16.32 is formed from an elastic material or from a foamed material, and exhibits a width B1 which is greater than the width B2 of the respective handle 4.

At least one possible embodiment of the present application relates to the device for attaching handles 4 to packaging 3 or packaging groups 2, wherein the second suction region 12.12, 12.22, 12.32 provided in the second format part 16.12, 16.22, 16.32 is configured as elastically deformable in the direction of the associated longitudinal axis LA1, LA2, LA3.

At least one possible embodiment of the present application relates to the device for attaching handles 4 to packaging 3 or packaging groups 2, wherein the first and/or second suction region 12.11, 12.12, 12.21, 12.22, 12.31, 12.32 comprise at least one suction head 12.4 and a folding bellows element 12.5 arranged on the suction head, which is configured so as to be elastically deformable or compressible in the direction of the associated longitudinal axis LA1, LA2, LA3.

At least one possible embodiment of the present application relates to the device for attaching handles 4 to packaging 3 or packaging groups 2, wherein at least one first and/or second format parts 16.11, 16.12, 16.21, 16.22, 16.31, 16.32 comprise an upper side OB1, OB2 OB3 which is cambered as concave or substantially concave, and which is cambered in the direction of the associated longitudinal axis LA1, LA2, LA3 as well as along the longitudinal extension of the associated longitudinal axis LA1, LA2, LA3.

At least one possible embodiment of the present application relates to the device for attaching handles 4 to packaging 3 or packaging groups 2, wherein at least one holding and/or pressing device 10.1, 10.2, 10.3 of a corresponding applicator arm A1, A2, A3 comprises on its associated rear side RS1, RS2, RS3 at least one spring sheet 17.1, 17.2, 17.3, which is configured as cambered away from the associated longitudinal axis LA1, LA2, LA3.

At least one possible embodiment of the present application relates to the device for attaching handles 4 to packaging 3 or packaging groups 2, wherein a sensor device 18.1, 18.2, 18.3 is provided in the region of the free end of a corresponding applicator arm A1, A2, A3 on its corresponding front side VS1, VS2, VS3, configured in each case as a force sensor 18.1, 18.2, 18.3, by which sensor signal a further rotation of the handle applicator unit 7 can be controlled and/or regulated.

At least one possible embodiment of the present application relates to the device for attaching handles 4 to packaging 3 or packaging groups 2, wherein the handle applicator unit 7 comprises a sensor device 19 with which the relative location or the rotational location of the individual applicator arms A1, A2, A3 can be detected.

At least one other possible embodiment of the present application relates to a method for attaching handles 4 to packaging 3 or packaging groups 2, with which packaging 3 or packaging groups 2 which are being conveyed on a conveying device 6 in a conveying direction A are provided in each case with a self-adhesive handle 4 with which an endless strip, provided at least in sections with an adhesive layer, is conveyed above a packaging 3 or packaging groups 2, from which a handle 4, in each case with a free-end side adhesive portion, is cut off, and the handle 4 which is formed in such a way is pressed onto the packaging 3 or packaging groups 2, wherein the handle 4 is attached to the packaging 3 or packaging groups 2 by the device for attaching handles 4 to packaging 3 or packaging groups 2.

At least one additional possible embodiment relates to a package handle attachment arrangement to attach handles to packages comprising groups of containers, such as bottles, cans, boxes, pouches, and similar containers for containing beverages or food or similar products, said package handle attachment arrangement comprising: a conveyor being configured to move packages in a conveying direction; a handle applicator unit being disposed above said conveyor; said handle applicator unit being configured and disposed to rotate about a horizontal axis of rotation oriented transverse to the conveying direction; said handle applicator unit comprising at least two applicator arms oriented radially to the horizontal axis of rotation; each of said at least two applicator arms comprising a cutting tool configured to cut individual handle strips of self-adhesive strip material from an endless supply strip; each of said at least two applicator arms comprising at least one support surface configured to support portions of self-adhesive strip material upon rotation of said handle applicator unit, and to press portions of individual handle strips onto packages to form handles for manual carrying of packages; and a pressure distribution arrangement being operatively connected to each of said at least two applicator arms to generate, at said at least one support surface of each of said at least two applicator arms, pressures of different duration and/or intensity and/or amount, depending on the rotational position of said handle applicator unit, which pressures comprise: a first pressure comprising a negative pressure to hold portions of self-adhesive strip material against said at least one support surface by vacuum suction upon said handle applicator unit being in a first rotational position, and at least one other pressure different from said first pressure upon said handle applicator unit being in at least one other rotational position different from said first rotational position.

At least one additional possible embodiment relates to the package handle attachment, wherein said at least one other pressure is higher than said first pressure.

At least one additional possible embodiment relates to the package handle attachment, wherein said at least one other pressure comprises: a second pressure comprising either atmospheric pressure or a negative pressure; and a third pressure comprising a positive pressure higher than atmospheric pressure.

At least one additional possible embodiment relates to the package handle attachment, wherein said pressure distribution arrangement, for each of said support surfaces, is configured to: temporarily operatively connect said support surface to a vacuum source to generate said first pressure at said support surface upon said handle applicator unit being in said first rotational position; temporarily operatively connect said support surface to a pressure source to generate said third pressure at said support surface upon said handle applicator unit being in a third rotational position different from said first rotational position; and temporarily operatively disconnect said support surface from any pressure source or vacuum source to generate said second pressure at said support surface upon said handle applicator unit being in said second rotational position different from said first and third rotational positions.

At least one additional possible embodiment relates to the package handle attachment, wherein said first rotational position comprises a position in which at least one of said support surfaces is in holding contact with a portion of self-adhesive strip material to permit said handle applicator unit to draw self-adhesive strip material from an endless supply strip or transport portions of individual handle strips to packages. 6. The package handle attachment arrangement according to claim 5, wherein said third rotational position comprises a position in which said at least one of said support surfaces is disposed to press an adhesive portion of an individual handle strip onto a package, such that, due to said third, positive, pressure, an air gap is created between the adhesive portion and said at least one of said support surfaces to promote disconnection and transfer of the adhesive portion from said at least one of said support surfaces to the package.

At least one additional possible embodiment relates to the package handle attachment, wherein said second rotational position comprises at least one of: a position in which at least one of said support surfaces is not in contact with a portion of self-adhesive strip material; and a position in which said at least one of said support surfaces is disposed to press an adhesive portion of an individual handle strip onto a package such that, due to said second pressure being higher than said first, negative, pressure, a reduced suction force or no suction force exists between the adhesive portion and said at least one of said support surfaces to promote disconnection and transfer of the adhesive portion from said at least one of said support surfaces to the package.

At least one additional possible embodiment relates to the package handle attachment, wherein each of said applicator arms is adjustable in length along a corresponding longitudinal axis.

At least one additional possible embodiment relates to the package handle attachment, wherein: said at least one support surface comprises pairs of support surfaces, one pair for each of said applicator arms; and each pair of support surfaces comprises: a first support surface disposed on a front side of its applicator arm and configured to press a first adhesive end of individual handle strips onto the leading side of packages, as viewed along the conveying direction, and thereby initially attach individual handle strips to packages; and a second support surface disposed on a back side of its applicator arm and configured to press a second adhesive end of individual handle strips onto the trailing side of packages, as viewed along the conveying direction, and thereby completely attach individual handle strips to packages to form package handles.

At least one additional possible embodiment relates to the package handle attachment, wherein: each of said applicator arms comprises a first plate-shaped format part disposed at its front side, and a second plate-shaped format part disposed at its rear side; each of said first support surfaces is disposed on a corresponding first plate-shaped format part, and each of said second support surfaces is disposed on a corresponding second plate-shaped format part; and each of said first and second plate-shaped format parts comprises at least one air opening therein to permit generation of pressure at its corresponding first and second support surface.

At least one additional possible embodiment relates to the package handle attachment, wherein: each of said first and second plate-shaped format parts comprises an elastic material or a foam material to permit elastic deformation of each of said first and second plate-shaped format parts in a substantially radial direction with respect to a central longitudinal axis of its corresponding applicator arm; and each of said first and second plate-shaped format parts comprises a width that is greater than the width of the self-adhesive strip material.

At least one additional possible embodiment relates to the package handle attachment, wherein at least one of said first and second plate-shaped format parts comprises at least one suction head and a folding bellows element arranged on the suction head configured to be elastically deformable or compressible in a substantially radial direction with respect to said central longitudinal axis of its corresponding applicator arm.

At least one additional possible embodiment relates to the package handle attachment, wherein at least one of said first and second support surfaces is cambered as concave or substantially concave both toward said central longitudinal axis of its corresponding applicator arm and along the longitudinal extension of said central longitudinal axis of its corresponding applicator arm.

At least one additional possible embodiment relates to the package handle attachment, wherein at least one of said applicator arms comprises at least one spring sheet disposed on its rear side and configured as cambered away from said central longitudinal axis of its corresponding applicator arm.

At least one additional possible embodiment relates to the package handle attachment, wherein each of said applicator arms comprises a force sensor device disposed on its front side at the end of said applicator arms, and configured to generate a sensor signal to permit control of rotation of said handle applicator unit.

At least one additional possible embodiment relates to the package handle attachment, wherein said handle applicator unit comprises a sensor device configured to detect the relative location or the rotational location of each of said applicator arms.

At least one additional possible embodiment relates to the package handle attachment, wherein said at least two applicator arms comprises at least three applicator arms.

At least one other additional possible embodiment relates to a method of attaching package handles to packages, such as bottles, cans, boxes, pouches, and similar containers for containing beverages or food or similar products, using the package handle attachment arrangement, said method comprising the steps of: moving packages, with a conveyor, in a conveying direction under and past a handle applicator unit disposed above said conveyor; rotating said handle applicator unit about a horizontal axis of rotation oriented transverse to the conveying direction, which said handle applicator unit comprises at least two applicator arms oriented radially to the horizontal axis of rotation; drawing, using said at least two applicator arms, self-adhesive strip material from an endless supply strip by holding a portion of said self-adhesive strip material against a support surface of said at least two applicator arms by vacuum suction; cutting, using a cutting tool of each of said at least two applicator arms, individual handle strips of self-adhesive strip material from said endless supply strip; continuing rotating said handle applicator unit and thereby moving said individual handle strips, held by vacuum suction against said support surfaces of said at least two applicator arms, to said packages being moved by said conveyor; pressing self-adhesive portions of individual handle strips onto packages to form handles for manual carrying of packages; generating, using a pressure distribution arrangement operatively connected to each of said at least two applicator arms, at said at least one support surface of each of said at least two applicator arms, pressures of different duration and/or intensity and/or amount, depending on the rotational position of said handle applicator unit, which step of generating comprises: moving said handle applicator unit to a first rotational position and generating a first pressure comprising a negative pressure to hold portions of self-adhesive strip material against said at least one support surface by vacuum suction, and moving said handle applicator unit to at least one other rotational position different from said first rotational position and generating at least one other pressure different from said first pressure.

At least one other additional possible embodiment relates to the method of attaching package handles to packages, wherein said at least one other pressure comprises a second pressure comprising either atmospheric pressure or a negative pressure, and a third pressure comprising a positive pressure higher than atmospheric pressure, and wherein said method further comprises: temporarily operatively connecting said support surface to a vacuum source and generating said first pressure at said support surface upon said handle applicator unit being in said first rotational position; temporarily operatively connecting said support surface to a pressure source and generating said third pressure at said support surface upon said handle applicator unit being in a third rotational position different from said first rotational position; and temporarily operatively disconnecting said support surface from any pressure source or vacuum source and generating said second pressure at said support surface upon said handle applicator unit being in said second rotational position different from said first and third rotational positions.

At least one other additional possible embodiment relates to the method of attaching package handles to packages, wherein after and/or during pressing of self-adhesive portions of individual handle strips onto packages, said support surface is temporarily disconnected from said vacuum source and then temporarily connected to said pressure source, such that said third, positive, pressure is generated at said support surfaces to create an air gap between said self-adhesive portions and said support surfaces to promote disconnection and transfer of said self-adhesive portions from said support surfaces to said packages.

The entirety of the appended drawings, including all dimensions, proportions, and/or shapes disclosed thereby or reasonably understood therefrom, are hereby incorporated by reference.

All of the patents, patent applications, patent publications, and other documents cited herein, are hereby incorporated by reference as if set forth in their entirety herein.

The corresponding foreign or international patent applications, as originally filed and as published, from which the present application claims the benefit of priority, are hereby incorporated by reference as if set forth in their entirety herein, as follows: International Patent Application No. PCT/EP2019/065979, filed Jun. 18, 2019, and Federal Republic of Germany Patent Application No. DE 102018118043, filed Jul. 25, 2018.

The following patents, patent applications, patent publications, and other documents cited in the International Search Report, dated Nov. 29, 2019, are hereby incorporated by reference as if set forth in their entirety herein, as follows: EP1088761A1; EP0669890A1; U.S. Pat. Nos. 5,111,633A; 3,634,173A; DE10056115A1; DE20207217U1; EP1577219A1; FR2787416A1; and EP1464582A2.

The following patents, patent applications, patent publications, and other documents are hereby incorporated by reference as if set forth in their entirety herein, as follows: U.S. Pat. Nos. 4,767,390A; 5,458,726A; DE69308878T2; DE3715445A1; and EP0560699A1.

Although the invention has been described in detail for the purpose of illustration of any embodiments disclosed herein, including the most practical or preferred embodiments at the time of filing of this application, it is to be understood that such detail is solely for that purpose and that the invention is not limited to such embodiments, but, on the contrary, is intended to cover modifications and equivalent arrangements that are within the spirit and scope of the present application, including the specification and the claims as originally filed, as amended, or as issued. For example, it is to be understood that the present invention contemplates that, to the extent possible, one or more features or components of any disclosed embodiment can be combined with one or more features or components of any other disclosed embodiment.

What is claimed is:

1. A package handle attachment arrangement to attach handles to packages comprising groups of containers, said package handle attachment arrangement comprising:

a conveyor being configured to move packages in a conveying direction;

a handle applicator unit being disposed above said conveyor;

said handle applicator unit being configured and disposed to rotate about a horizontal axis of rotation oriented transverse to the conveying direction;

said handle applicator unit comprising at least two applicator arms oriented radially to the horizontal axis of rotation;

each of said at least two applicator arms comprising a cutting tool configured to cut individual handle strips of self-adhesive strip material from an endless supply strip;

each of said at least two applicator arms comprising at least one support surface configured to support portions of self-adhesive strip material upon rotation of said handle applicator unit, and to press portions of individual handle strips onto packages to form handles for manual carrying of packages; and a pressure distribution arrangement being operatively connected to each of said at least two applicator arms to generate, at said at least one support surface of each of said at least two applicator arms, pressures of different duration and/or intensity and/or amount, depending on the rotational position of said handle applicator unit, which pressures comprise:

a first pressure comprising a negative pressure to hold portions of self-adhesive strip material against said at least one support surface by vacuum suction upon said handle applicator unit being in a first rotational position, and at least one other pressure different from said first pressure and different from atmospheric pressure upon said handle applicator unit being in at least one other rotational position different from said first rotational position.

2. The package handle attachment arrangement according to claim 1, wherein said at least one other pressure is higher than said first pressure.

3. The package handle attachment arrangement according to claim 2, wherein said at least one other pressure comprises:

a second pressure comprising either atmospheric pressure or a negative pressure; and a third pressure comprising a positive pressure higher than atmospheric pressure.

4. The package handle attachment arrangement according to claim 3, wherein said pressure distribution arrangement, for each of said support surfaces, is configured to:

temporarily operatively connect said support surface to a vacuum source to generate said first pressure at said support surface upon said handle applicator unit being in said first rotational position;

temporarily operatively connect said support surface to a pressure source to generate said third pressure at said support surface upon said handle applicator unit being in a third rotational position different from said first rotational position; and temporarily operatively disconnect said support surface from any pressure source or vacuum source to generate said second pressure at said support surface upon said handle applicator unit being in said second rotational position different from said first and third rotational positions.

5. The package handle attachment arrangement according to claim 4, wherein said first rotational position comprises a position in which at least one of said support surfaces is in holding contact with a portion of self-adhesive strip material to permit said handle applicator unit to draw self-adhesive strip material from an endless supply strip or transport portions of individual handle strips to packages.

6. The package handle attachment arrangement according to claim 5, wherein said third rotational position comprises a position in which said at least one of said support surfaces is disposed to press an adhesive portion of an individual handle strip onto a package, such that, due to said third, positive, pressure, an air gap is created between the adhesive portion and said at least one of said support surfaces to promote disconnection and transfer of the adhesive portion from said at least one of said support surfaces to the package.

7. The package handle attachment arrangement according to claim 6, wherein said second rotational position comprises at least one of:

a position in which at least one of said support surfaces is not in contact with a portion of self-adhesive strip material; and a position in which said at least one of said support surfaces is disposed to press an adhesive portion of an individual handle strip onto a package such that, due to said second pressure being higher than said first, negative, pressure, a reduced suction force or no suction force exists between the adhesive portion and said at least one of said support surfaces to promote disconnection and transfer of the adhesive portion from said at least one of said support surfaces to the package.

8. The package handle attachment arrangement according to claim 7, wherein each of said applicator arms is adjustable in length along a corresponding longitudinal axis.

9. The package handle attachment arrangement according to claim 8, wherein:

said at least one support surface comprises pairs of support surfaces, one pair for each of said applicator arms; and each pair of support surfaces comprises:

a first support surface disposed on a front side of its applicator arm and configured to press a first adhesive end of individual handle strips onto the leading side of packages, as viewed along the conveying direction, and thereby initially attach individual handle strips to packages; and a second support surface disposed on a back side of its applicator arm and configured to press a second adhesive end of individual handle strips onto the trailing side of packages, as viewed along the conveying direction, and thereby completely attach individual handle strips to packages to form package handles.

10. The package handle attachment arrangement according to claim 9, wherein:

each of said applicator arms comprises a first plate-shaped format part disposed at a front side thereof, and a second plate-shaped format part disposed at a rear side thereof;

each of said first support surfaces is disposed on a corresponding first plate-shaped format part, and each of said second support surfaces is disposed on a corresponding second plate-shaped format part; and each of said first and second plate-shaped format parts comprises at least one air opening therein to permit generation of pressure at its corresponding first and second support surface.

11. The package handle attachment arrangement according to claim 10, wherein:

each of said first and second plate-shaped format parts comprises an elastic material or a foam material to permit elastic deformation of each of said first and second plate-shaped format parts in a substantially radial direction with respect to a central longitudinal axis of its corresponding applicator arm; and each of said first and second plate-shaped format parts comprises a width that is greater than the width of the self-adhesive strip material.

12. The package handle attachment arrangement according to claim 11, wherein at least one of said first and second plate-shaped format parts comprises at least one suction head and a folding bellows element arranged on the suction head configured to be elastically deformable or compressible in a substantially radial direction with respect to said central longitudinal axis of its corresponding applicator arm.

13. The package handle attachment arrangement according to claim 12, wherein at least one of said first and second support surfaces is cambered as concave or substantially concave both toward said central longitudinal axis of its corresponding applicator arm and along the longitudinal extension of said central longitudinal axis of its corresponding applicator arm.

14. The package handle attachment arrangement according to claim 13, wherein at least one of said applicator arms comprises at least one spring sheet disposed on its rear side and configured as cambered away from said central longitudinal axis of its corresponding applicator arm.

15. The package handle attachment arrangement according to claim 14, wherein each of said applicator arms comprises a force sensor device disposed on its front side at the end of said applicator arms, and configured to generate a sensor signal to permit control of rotation of said handle applicator unit.

16. The package handle attachment arrangement according to claim 15, wherein said handle applicator unit comprises a sensor device configured to detect the relative location or the rotational location of each of said applicator arms.

17. The package handle attachment arrangement according to claim 4, wherein said at least two applicator arms comprises at least three applicator arms.

18. A method of attaching package handles to packages, using a package handle attachment arrangement according to claim 1, said method comprising the steps of:

moving the packages, with said conveyor, in the conveying direction under and past said handle applicator unit disposed above said conveyor;

rotating said handle applicator unit about a horizontal axis of rotation oriented transverse to the conveying direction, which said handle applicator unit comprises at least two applicator arms oriented radially to the horizontal axis of rotation;

drawing, using said at least two applicator arms, the self-adhesive strip material from the endless supply strip by holding a portion of said self-adhesive strip material against the support surface of said at least two applicator arms by vacuum suction;

cutting, using said cutting tool of each of said at least two applicator arms, individual handle strips of self-adhesive strip material from said endless supply strip;

continuing rotating said handle applicator unit and thereby moving said individual handle strips, held by vacuum suction against said support surfaces of said at least two applicator arms, to said packages being moved by said conveyor;

pressing self-adhesive portions of individual handle strips onto packages to form handles for manual carrying of packages;

generating, using a pressure distribution arrangement operatively connected to each of said at least two applicator arms, at said at least one support surface of each of said at least two applicator arms, pressures of different duration and/or intensity and/or amount, depending on the rotational position of said handle applicator unit, which step of generating comprises:

moving said handle applicator unit to a first rotational position and generating a first pressure comprising a negative pressure to hold portions of self-adhesive strip material against said at least one support surface by vacuum suction, and moving said handle applicator unit to at least one other rotational position different from said first rotational position and generating at least one other pressure different from said first pressure and different from atmospheric pressure.

19. The method of attaching package handles to packages according to claim 18, wherein said at least one other pressure comprises a second pressure comprising a pressure different from the first pressure, and a third pressure comprising a positive pressure higher than atmospheric pressure, and wherein said method further comprises:

temporarily operatively connecting said support surface to a vacuum source and generating said first pressure at said support surface upon said handle applicator unit being in said first rotational position;

temporarily operatively connecting said support surface to a pressure source and generating said third pressure at said support surface upon said handle applicator unit being in a third rotational position different from said first rotational position; and temporarily operatively disconnecting said support surface from any pressure source or vacuum source and generating said second pressure at said support surface upon said handle applicator unit being in said second rotational position different from said first and third rotational positions.

20. The method of attaching package handles to packages according to claim 19, wherein after and/or during pressing of self-adhesive portions of individual handle strips onto packages, said support surface is temporarily disconnected from said vacuum source and then temporarily connected to said pressure source, such that said third, positive, pressure is generated at said support surfaces to create an air gap between said self-adhesive portions and said support surfaces to promote disconnection and transfer of said self-adhesive portions from said support surfaces to said packages.

* * * * *